US006248969B1

(12) United States Patent
Komuro et al.

(10) Patent No.: US 6,248,969 B1
(45) Date of Patent: Jun. 19, 2001

(54) VACUUM CIRCUIT BREAKER, AND VACUUM BULB AND VACUUM BULB ELECTRODE USED THEREFOR

(75) Inventors: Katsuhiro Komuro; Yoshitaka Kojima, both of Hitachi; Noboru Baba; Ryo Hiraga, both of Hitachiohta; Toru Tanimizu, HItachi; Yoshimi Hakamata, Hitachi; Katsumi Kuroda, Hitachi; Hitoshi Okabe, Hitachi; Shigeru Kikuchi, Tokai-mura, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/154,840

(22) Filed: Sep. 17, 1998

(30) Foreign Application Priority Data

Sep. 19, 1997 (JP) ..... 9-254687

(51) Int. Cl.[7] ..... H01H 33/66
(52) U.S. Cl. ..... 218/118; 218/123
(58) Field of Search ..... 218/115, 123–128

(56) References Cited

U.S. PATENT DOCUMENTS 5,004,877 * 4/1991 Yin ..... 218/118
5,763,848 * 6/1998 Hakamata et al. ..... 218/118

FOREIGN PATENT DOCUMENTS 195 13 790 10/1995 (DE) .
193 37 657 4/1997 (DE) .
634766 1/1995 (EP) .
740 321 10/1996 (EP) .
917171 5/1999 (EP) .
931528 7/1963 (GB) .
50-21670 7/1975 (JP) .
63-96204 4/1988 (JP) .
3-17335 3/1991 (JP) .
WO90/15424 12/1990 (WO) .
WO91/19308 12/1991 (WO) .

* cited by examiner

*Primary Examiner*—Lincoln Donovan
(74) *Attorney, Agent, or Firm*—Mattingly, Stanger & Malur

(57) ABSTRACT

Disclosed is a vacuum circuit breaker including a small-sized electrode structure capable of reducing deformation with age thereby enhancing the reliability and a vacuum bulb and a vacuum bulb electrode used for the breaker. In the vacuum circuit breaker, each of a fixed electrode and a movable side electrode includes an arc electrode made from particles of a refractory metal material, a high conductive metal material and a low melting point metal; an electrode supporting portion, made from the high conductive metal material, for supporting the arc electrode; a back conductor having a diameter smaller than the electrode supporting portion; and an external side connecting portion having a diameter larger than that of the back conductor. The arc electrode is integrated with the electrode supporting portion, back conductor, and external side connecting portion by the high conductive metal material, preferably, by melting of the highly conductive metal material.

14 Claims, 12 Drawing Sheets

VACUUM CIRCUIT BREAKER, AND VACUUM BULB AND VACUUM BULB ELECTRODE USED THEREFOR

BACKGROUND OF THE INVENTION

The present invention relates to a new vacuum circuit breaker, and a vacuum bulb and a vacuum bulb electrode used for the vacuum circuit breaker.

Vacuum circuit breakers each contain an electrode structure composed of a pair of a fixed electrode and a movable electrode. Each of the fixed electrode and movable electrode has four parts: an arc electrode, an arc electrode supporting member, a coil electrode connected to the arc electrode supporting member, and an electrode rod provided on an end of the coil electrode.

An arc electrode is directly exposed to arc each time it switchingly breaks a high voltage and a high current. In general, an arc electrode is required to satisfy basic characteristics such as a large breaking capacity, high withstand voltage, small contact resistance (high electric conductivity), high fusion resistance, small wastage of a contact, and small chopped current. However, it is difficult for an arc electrode to satisfy all of these characteristics, and consequently, an arc electrode is generally made from a material selected to satisfy characteristics particularly important for the application and to sacrifice other ones to some extent. A method of manufacturing an arc electrode material suitable for breaking a large current and a high voltage is disclosed in Japanese Patent Laid-open No. Sho 63-96204, wherein Cu is filtrated in a skeleton of Cr or Cr—Cu. Such a method is also disclosed in Japanese Patent Publication No. Sho 50-21670.

In the above method, to enhance the fusion resistance and reduce the chopped current, it may be considered to filtrate Cu added with a low melting point metal such as Pb, Bi, Te or Sb in a skeleton of Cr or Cr—Cu for uniformly dispersing the low melting point metal such as Pb in the skeleton; however, it is difficult to realize such a method because of a large difference in specific gravity between Cr or Cr—Cu and the low melting point metal.

Further, an arc electrode formed of a sintered body or an ingot added with a low melting point metal such as Pb, Bi, Te or Sb is poor in brazing characteristic with an electrode supporting member. As a result, when such an arc electrode is brazed with the arc electrode supporting member, the strength of a brazing interface therebetween is weaken.

An arc electrode supporting member, which is used mainly for reinforcing an arc electrode, exhibits another effect of generating a vertical magnetic field if it is formed into a shape suitable therefor. The arc electrode supporting member is made from pure Cu having a preferable conductivity.

A coil electrode is provided mainly for allowing an arc electrode to generate a vertical magnetic field and letting the arc generated from the arc electrode due to the field be diffused over the arc electrode, and also for forcibly breaking the arc. For this purpose, the coil electrode is formed into a shape suitable therefor. As disclosed in Japanese Patent Publication Hei 3-17335, the coil electrode also serves as a member for reinforcing an arc electrode and an arc electrode supporting member. The coil electrode is made from the same material as that of an arc supporting member, that is, pure Cu.

The electrode structure composed of an arc electrode, arc electrode supporting member, coil electrode and electrode rod is manufactured in accordance with steps of preparing an arc electrode and machining it; machining an arc electrode supporting member, coil electrode and electrode rod; and assembling these parts, followed by brazing.

An arc electrode is prepared by a power metallurgical process of mixing powders of Cr, Cu, W, Co, Mo, V, and/or Nb or an alloy thereof in a specific composition, compressing the mixture into a compact having a specific shape and a specific porosity, sintering the compact, and filtrating molten Cu or Cu alloy in a skeleton of the sintered body. In the above process, in the sintering step, a sinter body having the density of 100% may be produced. The sintered body thus obtained is then machined into a specific shape, to prepare an arc electrode.

Each of the arc electrode supporting member, coil electrode and electrode rod is machined from a pure Cu material into a specific shape suitable for generation of a vertical magnetic field.

The parts thus prepared are assembled, followed by brazing, to obtain an electrode structure. Here, brazing is performed by inserting a brazer having a wettability between the arc electrode, arc electrode supporting member, coil electrode and electrode rod, and heating them in a vacuum or a reducing atmosphere. Accordingly, in manufacture of the electrode structure assembled by brazing, it takes a lot of labor and time in machining each part and alignment of parts for brazing. Further, in brazing between the arc electrode containing a low melting point metal such as Pb and the arc electrode supporting member in accordance with the conventional method, there occurs a disadvantage that the wettability of brazer is deteriorated because of segmentation of Pb in the arc electrode and the presence of Pb at the interface between the arc electrode and the arc electrode supporting member. In addition, for an electrode structure having a large diameter, there may occur breakage and/or slip-off of an electrode material due to defective brazing. Therefore, the electrode structure manufacture in accordance with the conventional method is poor in uniformity of electrode characteristic, reliability, and safety.

Recently, along with the advanced development of a material, an attempt has been made to switchingly break a large current and a high voltage by suitably setting a design specification of vacuum circuit. For example, a breaking performance is improved by increasing an input speed. The increased input speed, however, increases a contact force between arc electrodes and also gives a impact stress on the entire electrode upon opening/closing the electrode structure. This causes deformation of the electrode material with time. In general, an arc electrode is made from a high strength material being good in breaking characteristic and fusion resistance; however, each of an arc electrode supporting member, coil electrode and electrode rod is made from pure Cu which is very small in proof stress. Further, since the arc electrode supporting member is provided with grooves in the direction of cross-section for generating a vertical magnetic field, and therefore, it cannot withstand an impact stress and is deformed with time. The deformation of the electrode material causes an inconvenience in opening/closing of the electrode structure, fusion, breakage and/or slip-off of an arc electrode, and a trouble of emergent opening/closing of the electrode structure.

SUMMARY OF THE INVENTION

An object of the present invention is to provide a vacuum circuit breaker including a small-sized electrode structure capable of reducing deformation with age thereby enhancing the reliability and a vacuum bulb and a vacuum bulb electrode used for the breaker.

According to the present invention, there is provided a vacuum circuit breaker including: a vacuum bulb having a fixed electrode and a movable electrode disposed preferably in an insulating vacuum vessel; terminals for connecting external conductors to the fixed electrode and the movable electrode; and preferably an opening/closing means for driving the movable electrode through an insulating rod connected to the movable electrode. Each of the fixed electrode and the movable electrode includes: an arc electrode made from an alloy containing particles of a refractory metal material, a highly conductive metal material and preferably, a low melting point metal material; an electrode supporting portion, made from the highly conductive metal material, for supporting the arc electrode; a back conductor having a diameter smaller than that of the electrode supporting portion; and an external side connecting portion to be connected to an external conductor, the external side connecting portion having a diameter larger than that of the back conductor; wherein the arc electrode, the electrode supporting portion, the back conductor, and the external side connecting portion are formed integrally with each other by means of the highly conductive metal material. Preferably, the particles of the refractory metal material contains, on the basis of the total weight of refractory metal material, particles of the particle size of 140 $\mu$m or more in an amount of 5% or less; particles of 70 to 140 $\mu$m in an amount of 45 to 90%; particle of 40 to 70 $\mu$m in an amount of 7 to 35%; and particle of less than 40 $\mu$m in an amount of 0.5 to 15%.

In the electrode of the present invention, as will be described later, the electrode supporting portion and the back conductor are made from a high strength alloy mainly containing a highly conductive metal incorporated with other metals, whereby in particular the diameter of the back conductor can be reduced, so that the generated arc can be readily driven and local heating can be prevented. Consequently, as compared with the related art electrode having the same breaking capacity, the diameter of the arc electrode can be reduced and the diameter of the back conductor can be reduced to a half of the arc electrode or less. Further, since the heat caused by arc can not be scattered only by use of the thinned back conductor, the external side connecting portion to be connected to an external conductor, which is larger in diameter than the back conductor, is provided to thereby miniaturize the electrode and enable a large capacity breaking.

The arc electrode is preferably made from an alloy containing a mixture of one kind or two kinds or more selected from Cr, W, Mo, and Ta, a highly conductive metal material composed of one kind selected from Cu, Ag and Au, a highly conductive alloy mainly containing the highly conductive metal material, and preferably one kind or two kinds or more selected from Pb, Bi, Te, and Sb. The electrode supporting portion is preferably made from the above highly conductive metal or the highly conductive metal alloy containing the highly conductive metal material.

The arc electrode is preferably made from an alloy containing one kind or two kinds or more selected from a group consisting of Cr, W, Mo and Ta in a total amount of 20 to 80 wt %, one kind selected from a group consisting of Cu, Ag and Au or an alloy mainly containing the metal in an amount of 20 to 80 wt %, and preferably one kind or two kinds or more selected from a group consisting of Pb, Bi, Te and Sb in a total amount of 1.0 wt % or less. Each of the electrode supporting portion, back conductor and external side connecting portion is preferably made from an alloy containing one kind or two kinds or more selected from a group consisting of Cr, Ag, W, V, Nb, Mo, Ta, Zr, Si, Be, Ti, Co and Fe in a total amount of 2.5 wt % or less, and Cu, Ag or Au.

The arc electrode in the present invention is made from a composite alloy in which a highly conductive metal material is impregnated in a porous refractory metal material, and the arc electrode is preferably formed integrally with the electrode supporting portion, back conductor and external side connecting portion by melting of the highly conductive metal material.

The electrode supporting portion in the present invention preferably has a 0.2% proof stress of 10 kg/cm$^2$ and a specific resistance of 2.8 $\mu\Omega$·cm or less.

According to the present invention, the arc electrodes of the fixed electrode and movable electrode, which are to be brought in contact with each other, each have at its central portion a recess formed into a complete round shape.

The arc electrode, electrode supporting portion, back conductor and external side connecting portion are preferably formed integrally with each other by melting and solidification of the highly conductive metal material or powder metallurgical solid-state bonding.

A plurality, preferably 3 to 6 pieces, of spiral or linear slit grooves are preferably provided in the arc electrode and electrode supporting portion.

A plurality of arc running faces are formed between the slit grooves. Each of the slit grooves is composed of a main slit groove extending from the central portion of the electrode to the outer peripheral end thereof before the outer peripheral ends of the arc running faces, and an outer peripheral slit groove extending from the outer peripheral end of the main slit groove to the side surface of the electrode. A communication portion is formed in such a manner as to cross the above outer peripheral slit groove. The communicating portion has the same resistance as that of each of both the arc running faces in which a current path is different in length between both the arc running faces. Preferably, a current flowing from each of the both arc running faces into the communicating portion is controlled by adjustment of the cross-section of the communicating portion.

The width of the communication portion is preferably set such that $D_2/D_1$ is in a range of 0.9 to 1 where $D_1$ and $D_2$ are an outside diameter and an inside diameter of the communication portion.

The thickness of the communication portion is preferably set in a range of 0.5 to 5 (mm).

A round face formed at an outer peripheral end of the arc running face is preferably set in a range of 0.5 to 1.5 R (mm).

A round face formed at an outer peripheral end of the communication portion is preferably set in a range of 0.5 to 1.5 R (mm).

The thickness of the communication portion is preferably set in a range of 0.5 to 5 (mm) and the round face formed at the outer peripheral end of the arc running face is preferably set in a range of 0.5 to 1.5 R (mm).

According to the present invention, there is provided a vacuum circuit breaker including:

a vacuum bulb having a fixed electrode and a movable electrode disposed preferably in an insulating vacuum vessel;

terminals for connecting external conductors to the fixed electrode and the movable electrode; and an opening/closing means for driving the movable electrode through an insulating rod connected to the movable electrode;

each of the fixed electrode and the movable electrode including:

an arc electrode made from an alloy containing particles of a refractory metal material and a highly conductive metal material; and an electrode supporting portion, made from the highly conductive metal material, for supporting the arc electrode;

wherein the arc electrode and the electrode supporting portion are formed integrally with each other by means of the highly conductive metal material;

the insulating vessel is formed into a cylindrical shape; and a value (y), which is a rating voltage (kV) multiplied by a cutoff current effective value (kA), is in a range not more than a value obtained by an equation (1) and not less than a value obtained by an equation (2):

$$y=11.25x-525 \quad (1)$$

$$y=5.35x-242 \quad (2)$$

where x (mm) is an outside diameter of the insulating vessel.

According to the present invention, a diameter y (mm) of the arc electrode is in a range not more than a value obtained by an equation (3) and not less than a value obtained by equation (4):

$$y=0.15x+22 \quad (3)$$

$$y=0.077x+18 \quad (4)$$

where x ($kVA\times10^3$) is a rating voltage (kV) multiplied by a cutoff current effective value (kA).

According to the present invention, the insulating vessel is formed into a cylindrical shape; and an outside diameter y (mm) of the insulating vessel is in a range not more than a value obtained by an equation (5) and not less than a value obtained by an equation (6):

$$y=1.26x+10 \quad (5)$$

$$y=1.26x+30 \quad (6)$$

where x (mm) is a diameter of the arc electrode.

The vacuum bulbs of three sets are horizontally arranged and integrally assembled in a resin made insulating cylinder.

According to the present invention, there is provided a vacuum bulb including:

a fixed electrode and a movable electrode provided preferably in the insulating vessel kept in a high vacuum state, each of the fixed electrode and the movable electrode including:

an arc electrode formed of a composite member containing particles of a refractory metal material, a highly conductive metal material, and preferably, a low melting point metal;

an electrode supporting portion, made from the highly conductive metal material, for supporting the arc electrode;

a back conductor having a diameter smaller than that of the electrode supporting portion; and an external side connecting portion to be connected to an external conductor, the external side connecting portion having a diameter larger than that of the back conductor;

wherein the arc electrode, the electrode supporting portion, the back conductor, and the external side connecting portion are formed integrally with each other by means of the highly conductive metal material.

The configuration of the electrode structure of the vacuum bulb is the same as described above.

According to the present invention, there is provided a vacuum bulb electrode including:

an arc electrode made from an alloy containing particles of a refractory metal material, a highly conductive metal material, and preferably, a low melting point metal material;

an electrode supporting portion, made from the highly conductive metal material, for supporting the arc electrode;

a back conductor having a diameter smaller than that of the electrode supporting portion; and an external side connecting portion to be connected to an external conductor, the external side connecting portion having a diameter larger than that of the back conductor;

wherein the arc electrode, the electrode supporting portion, the back conductor, and the external side connecting portion are formed integrally with each other by means of the highly conductive metal material.

The vacuum bulb electode of the present invention is preferably manufactured by a method wherein the arc electrode is formed by placing the highly conductive metal material on a porous sintered body containing a refractory metal material and melting the highly conductive metal material and filtrating it in the porous sintered body or solid-state diffusing the highly conductive metal material in the porous sintered body, and the electrode supporting portion, back conductor and external side connecting portion are formed of the remaining highly conductive metal material after filtration, the thickness of the highly conductive metal material being set to sufficiently remain for forming the above components after filtration. In particular, in the filtration of the present invention, the porous body is sintered at a temperature lower than but close to a melting point of the lower melting point metal for a sufficient time for diffusing the low melting point metal material in the particles of the refractory metal material and the highly conductive metal material, thereby preventing elimination of the low melting point metal material upon filtration. The heating temperature is preferably set at a value which is lower 30 to 100° C. than the melting point of the lower melting point metal material.

In the filtration of the present invention, the arc electrode and electrode supporting portion formed by filtration of the highly conductive metal material and solidification is preferably subjected to heat-treatment at a desired temperature for precipitating a metal or intermetallic compound dissolved in solid in the highly conductive metal material in an over-saturated state.

The above vacuum bulb electrode can be used for a fixed electrode or movable electrode.

The electrode structure of a vacuum circuit breaker has an arc electrode, arc electrode supporting member, back conductor and external side connecting portion. The arc electrode is made from a composite alloy containing a refractory metal material and a highly conductive metal material. As the refractory metal material, there is preferably used a metal having a high melting point of 1800° C. or more such as Cr, W, Mo, or Ta. Further, the dissolved amount in solid of the refractory metal material in the highly conductive metal material such as Cu, Ag or Au is preferably as small as 3% or less. Each of the arc electrode supporting portion, back conductor and external side connecting portion is preferably made from pure Cu; however, since pure Cu is small in strength, each part is preferably reinforced by an ion based material such as pure Fe, or stainless steel for preventing deformation thereof.

The arc electrode is made from an alloy containing a refractory metal material in an amount of 20 to 80 wt %, preferably, 35 to 65 wt %; one kind selected from a group consisting of Cu, Ag and Au and an alloy mainly containing the metal in an amount of 20 to 80 wt %, preferably, 35 to 65 wt %; or the above alloy containing Pb or the like in an amount of 1 wt % or less, preferably, 0.1 to 0.6 wt %. In particular, the arc electrode is preferably formed of a composite material obtained by filtrating a highly conductive metal in a porous sintered body containing the refractory metal material and the highly conductive metal material in an amount of 10 wt % or less.

The electrode structure has a double layer structure having a layer of the arc electrode and a layer of the arc electrode supporting portion, back conductor and external side connecting portion. The latter layer of the arc electrode supporting portion, back conductor and external side connecting portion is provided to reinforce and support the arc electrode, and preferably has a thickness of a half of the arc electrode or more, more preferably, a thickness being identical to or more the arc electrode. The porosity of the porous sintered body is preferably set in a range of 50 to 70%. In particular, as the refractory metal material, there may be used a Cr alloy containing one kind or two kinds or more selected from a group consisting of Nb, V, Fe, Ti and Zr in an amount of 0.1 to 10 wt %, preferably, 0.5 to 2 wt % for enhancing the withstand voltage characteristic.

The arc electrode of the present invention is preferably made from a Cu-filtrated alloy containing Cr in an amount of 30 to 60 wt %, Nb in an amount of 0.5 to 5.0 wt %, preferably, 0.5 to 3.0 wt %; or the above alloy containing Pb in an amount of 0.1 to 0.5 wt %.

According to the present invention, the arc electrode is metallurgically continuous to a member composed of the arc electrode supporting portion, back conductor and external side connecting portion. As a result, as described above, the slit grooves can be formed in the arc electrode and the arc electrode supporting portion. Also, since there is not problem in terms of brazing due to heat generation caused by arc upon interruption, the electrode structure can be miniaturized and enables breaking of a high current.

According to the present invention, in the electrode structure in which the arc electrode, arc electrode supporting portion, back conductor and external side connecting portion are metallurgically continuous to each other, as the highly conductive metal material forming the arc electrode supporting portion, back conductor and external side connecting portion, there can be used an alloy containing one kind or two kinds or more selected from a group consisting of Cr, Ag, W, V, Zr, Si, Mo, Ta, Be, Nb and Ti in an amount of 0.01 to 2.5 wt % and Au, Ag and Cu. Accordingly, it is possible to significantly increase the mechanical strength, particularly, proof stress of the member composed of the arc electrode supporting portion, back conductor and external side connecting portion with its electric conductivity not reduced so much. As a result, the above member can sufficiently withstand the increased contact pressure between the arc electrodes and an impact force upon opening/closing the electrodes.

In this way, by combination of the feature in which the arc electrode is not joined to but metallurgically continuous to the member composed of the arc electrode supporting portion, back conductor and external side connecting portion and the feature in which the strength of the above member is increased, the vacuum circuit breaker of the present invention can solve the problems of the conventional electrode structure and can increase the reliability and safety.

According to the filtration method of the present invention, powders of one or more of Cr, W, Mo and Ta, powders of one or more of Cu, Ag and Au, or powders of one or more of Pb, Bi, Te and Sb and the like are mixed in a specific ratio; and the mixed powder is compressed with a specific porosity and sintered, to form a porous sintered body. Then, a block of one or more of pure Cu, Ag and Au, and alloys thereof is placed on the sintered body, and pure Cu or Cu alloy is melted to be filtrated in voids of the porous sintered body. At this time, the melted metal used for filtration is alloyed to have the above described composition by positively making use of liquid-phase diffusion of the components of the sintered body in the melted metal for filtration. An ingot after completion of filtration is machined into an electrode having a specific shape.

In filtration of the highly conductive metal material, the dissolved amount of the components of the porous sintered body into the highly conductive metal material can be controlled on the basis of the filtration temperature and holding time. In particular, the filtration temperature and holding time are set in consideration of the specific resistance and strength of the member composed of the arc electrode supporting portion, back conductor and external side connecting portion. Of course, the highly conductive metal material for forming the above member may previously contain alloy elements. As a result, there can be obtained the member having a high strength and low specific resistance.

According to the present invention, the electrode structure having a specific shape can be manufactured by combination of the filtration and casting technique, and machined into a final shape.

The vacuum circuit breaker of the present invention can be used, together with a disconnect switch, earth switch, lightening protector, or current transformer, for high voltage receiving/transforming equipment of public facilities such as tall buildings, hotels, intelligent buildings, underground shopping centers, petroleum complex, various factories, stations, hospitals, halls, subways, and water supply/sewerage.

According to the present invention, there is provided a vacuum circuit breaker including a fixed electrode and a movable electrode each of which is composed of an arc electrode, an arc electrode supporting portion, back conductor and external side connecting portion. In this breaker, the arc electrode is not joined to but is integrated with the arc electrode supporting portion, back conductor and external side connecting portion by melting or solid-state diffusion of a common highly conductor metal material. In the case of the integration by melting of the highly conductive metal material, the arc electrode supporting portion, back conductor and external side connecting portion are made from a Cu alloy containing Cr, Ag, V, Nb, Zr, Si, W and Be in a total amount of 0.01 to 2.5 wt %. The electrode structure having the above configuration is effective to reduce the number of steps of machining and assembling parts to be brazed to each other, to prevent breakage and/or slip-off of the electrode material due to a brazing failure, to improve the strength of the electrode material, to prevent a fusion failure due to deformation of the electrode, and to prevent occurrence of fusion due to a large content of a low melting point metal such as Pb in the arc electrode. According to the present invention, therefore, it is possible to provide a small-sized vacuum circuit breaker having a high reliability and a high safety; a vacuum bulb used for the breaker; and an electric contact used for the vacuum bulb.

While the preferred embodiments have been described using specific terms, such description is for illustrative purposes only, and it is to be understood that changes and variations may be made without departing from the spirit or scope of the following claims.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Hereinafter, preferred embodiments of the present invention will be described with reference to the accompanying drawings.

[Embodiment 1]

Figure 1:
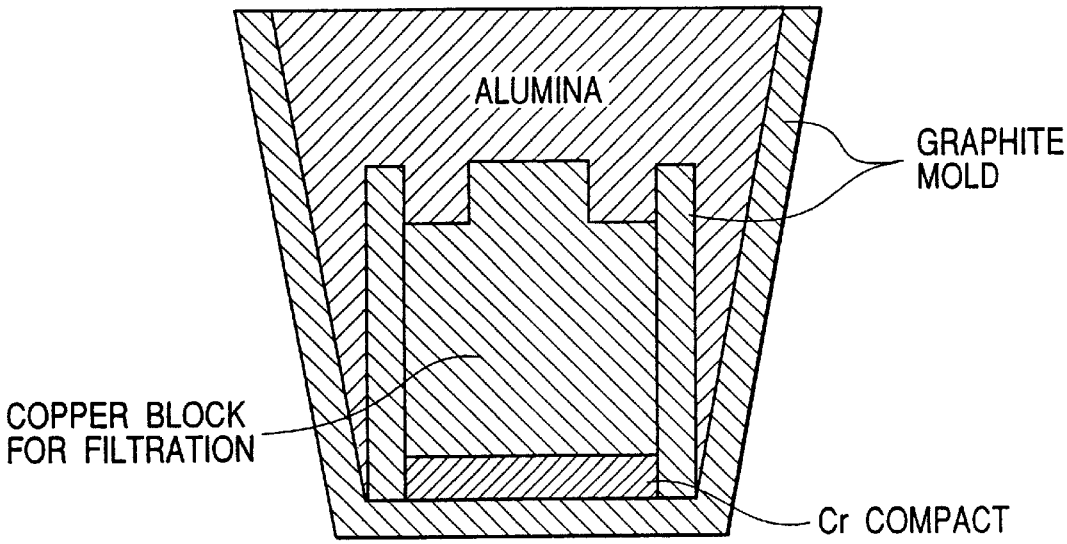
FIG. 1 is a sectional view showing a method of producing an electrode structure according to the present invention.

FIG. 1 is a sectional view showing a method of producing an integral electrode according to the present invention. In the figure, a Cr compact having the following composition is placed on the bottom of a graphite mold and a copper block for filtration is placed on the Cr compact.

A Cr compact having a diameter of 80 mm and a thickness of 9 mm was prepared by mixing a powder of Cu in an amount of 4.5 wt %, a powder of Cr in an amount of 95 wt %, a powder of Nb in an amount of 2 wt %, and a powder of Pb in an amount of 0.05 wt % (1.0 wt %, 1.5 wt %) using a V-type mixer, and compacting the mixed powder at a compacting pressure of 3.0 ton/cm$^2$ using a die having a diameter of 80 mm. Here, the Cr powder contains particles having the particle sizes of 140–170 $\mu$m (2 wt %), 95 to less than 140 $\mu$m (40 wt %), 70 to less than 95 $\mu$m (30 wt %), 60 to less than 70 $\mu$m (11 wt %), 40 to less than 60 $\mu$m (8 wt %), and less than 40 $\mu$m (10 wt %). A porosity of the compact was 75%. The compact was sintered in a vacuum of $10^{-5}$ Torr or less at a sintering temperature of 1050° C. for 120 min. In this sintering, the compact was held for a long time at a temperature lower than and close to about a melting point of Pb (that is, at a solid-phase temperature of Pb) and heated up to the specific temperature (1050° C.). A porosity of a sintered body was 65%. The porous sintered body was placed at a central portion of a bottom surface of a graphite mold having an inside diameter of 90 mm, an outside diameter of 100 mm and a height of 100 mm, and a pure copper block for filtration having a diameter of 80 mm and a length of 100 mm was placed on the porous sintered body. The copper block for filtration was provided with a filtration member serving as a riser, made from copper, having a diameter of 28 mm and a length of 25 mm. The side surfaces of the graphite vessel, the two members made from pure Cu, and the upper side of the filtration member serving as the riser were covered with a powder of $Al_2O_3$.

Figure 2:
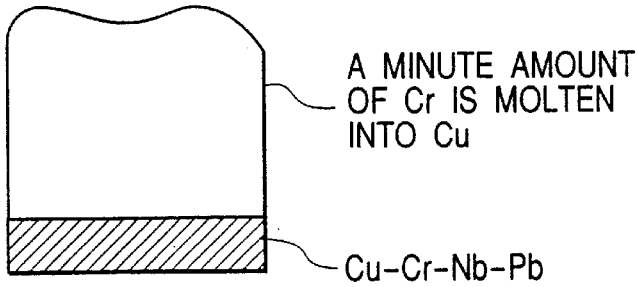
FIG. 2 is a sectional view of the electrode structure after the filtration step according to the present invention.

The porous sintered body and the pure copper block were held in a vacuum of $1\times10^{-5}$ Torr or less at 1150° C. for 60 min, so that the skeleton of the sintered body was homogeneously filtrated with the filtrant made from molten pure Cu. Then, the porous sintered body thus filtrated with pure Cu was naturally cooled in a vacuum atmosphere to be solidified. FIG. 2 is a sectional view showing the appearance of the ingot solidified and taken out of the graphite vessel. The portion of Cu, which has been used for filtration, is alloyed with Cr in an amount of 0.5 to 2 wt % and Nb in an amount of about 0.1 wt % or less. The ingot is cut into a shape shown in FIG. 3, which has an arc electrode 1, an arc electrode supporting portion 2, an external side connecting portion 3 to be connected to an external conductor, and a back conductor 4. As a result of microscopic examination of an boundary with the Cr compact, it was revealed that voids of the sintered body of the Cr particles are filtrated with Cu; and a plurality of the particles of Cr, which are bonded with each other, keep original shapes to the degree that particle sizes thereof can be measured.

According to the present invention, as described above, the arc electrode 1 is integrated with the arc electrode supporting portion 2, external side connecting portion 3, and back conductor 4. The arc electrode 1 has a thickness similar to that of the arc electrode supporting portion 2. The back conductor 4 having a diameter smaller than that of each of the arc electrode 1 and the arc supporting portion 2 is located therebetween. The interface between the arc electrode and the arc electrode supporting portion is perfectly metallographically continuous to both the arc electrode and the arc electrode supporting portion. This eliminate the need of joining the arc electrode to the arc electrode supporting portion by brazing or the like. As a result of analyzing Pb at the cross-section of the arc electrode 1, it was confirmed that Pb is uniformly dispersed over the cross-section of the arc electrode 1.

Three pieces of the ingots can be manufactured at once using three stages of the molds. Further, a specific number (more than three) of the ingots can be similarly manufactured at once.

Figure 3:
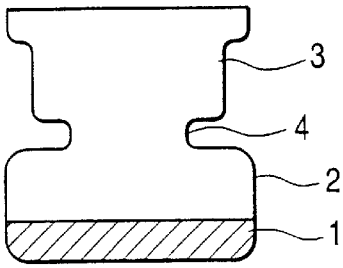
FIG. 3 is a sectional view of the electrode structure after the cutting step according to the present invention.

In the electrode structure obtained by cutting the ingot as shown in FIG. 3, the boundary layer between the arc electrode supporting portion 2 and the arc electrode 1 forms an alloy having a melting point higher than that of a brazing filler metal, for example, silver braze. As a result, the boundary layer is less melted and exhibits a high arc resistance, to thereby contribute to improvement of the current breaking capacity.

Figure 4:
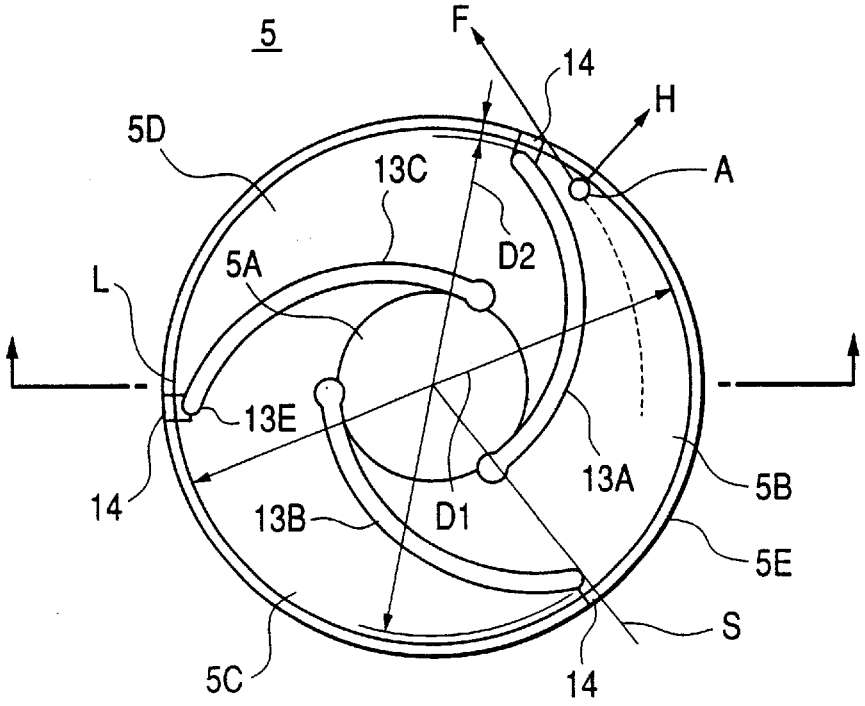
FIG. 4 is a plan view of the electrode structure having spiral grooves according to the present invention.
Figure 5:
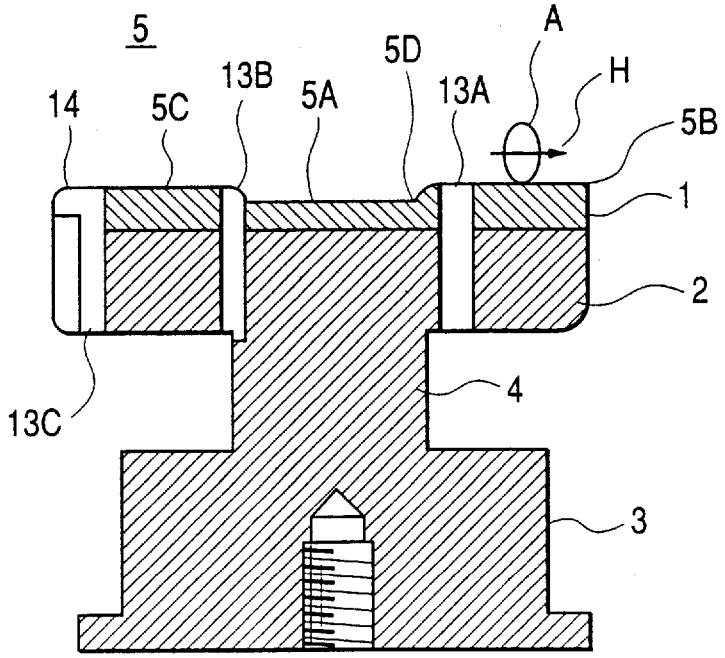
FIG. 5 is a sectional view of the electrode structure having the spiral grooves according to the present invention.

FIG. 4 is a plan view of a spiral type electrode structure in this embodiment, and FIG. 5 is a sectional view taken along arrows shown in FIG. 4. The electrode structure is, as shown in these figures, further cut into a shape having a complete round recess 5A at a central portion of the electrode structure; arc running faces 5B, 5C and 5D integrally formed outside the recess 5A in such a manner as to form a common contact face; and three pieces of slit grooves 13A, 13B and 13C spirally cut in the arc electrode 1 and the arc electrode supporting portion 2 between the arc running faces 5B and 5D, between the arc running faces 5B and 5C, and between the arc running faces 5C and 5D. Each of the slit grooves 13A, 13B and 13C extends from the recess 5A to a portion before a common outer peripheral end 5E of the arc running faces 5B, 5C and 5D. The number of the spiral slit grooves is not limited to three but may be four or five. The slit groove may be also formed into a curved shape or a linear shape. The diameter of the complete round recess 5A may be nearly equal to that of the back conductor 4.

Each of the slit grooves 13A, 13B and 13C is composed of a main slit groove extending from the recess 5A to an outer peripheral end 13E and an outer peripheral slit groove extending from the outer peripheral end 13E to the side surface of the electrode structure. The arc running faces 5A, 5B and 5C are formed between the slit grooves 13A, 13B and 13C. Communicating portions 14 function as bridges crossing the outer peripheral slit grooves of the slit grooves 13A, 13B and 13C between the ends 13E and 5E. The communicating portions 14 are formed integrally with the arc running faces 5A, 5C and 5D, and have the same resistance as that of the arc running faces 5A, 5B and 5C.

Accordingly, when an arc A flows between each arc running face and the communicating portion 14, it generates less heat. This is effective to improve the current capacity of the electrode structure. Further, the communicating portions 14, which can be formed integrally with the arc running faces 5B, 5C and 5D as described, can be set at the same level as that of the arc running faces 5B, 5C and 5D. In this case, the axial length of the electrode structure can be made smaller than that shown in FIG. 8, and further the electric field can be relaxed because of no concentration of the electric field at the communicating portions 14, to thereby further improve the cutoff current capacity.

The current control is performed by adjusting communicating portions 14 such that when a current path of a current "$i_1$" flowing on one side arc running face for example 5B is formed longer than a current path of a shunt current "$i_2$" flowing on the other side arc running face for example 5D, the current "$i_1$" flows from the one side arc running face 5B to the other side arc running face 5D. For example, a width L between an outside diameter and an inside diameter of the communicating portion 14 is suitably set. Concretely, the width L is set such that $D_2/D_1$ is more than 0.9 and less than 1 where $D_1$ and $D_2$ are the outside diameter and the inside diameter of the communicating portion 14, respectively. In this case, the communicating portion 14 is set such that the current path of the current $i_1$ flowing on the one side arc running face 5B is formed longer than the current path of the shunt current $i_2$ flowing on the other side arc running face 5D. The communicating portions 14 can be provided as grooves continuous to slit grooves.

Figure 8:
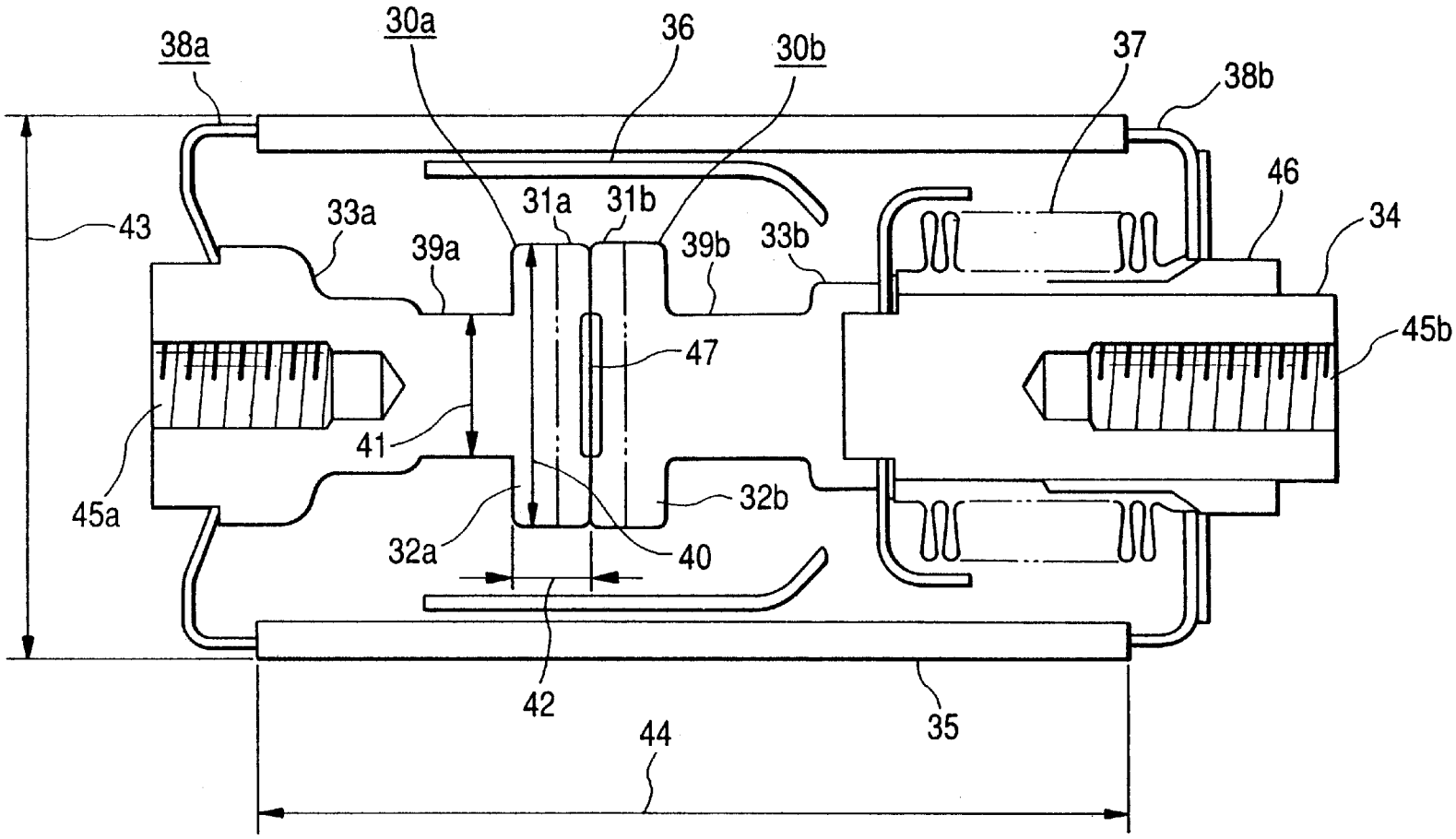
FIG. 8 is a sectional view of a vacuum bulb.
Figure 9:
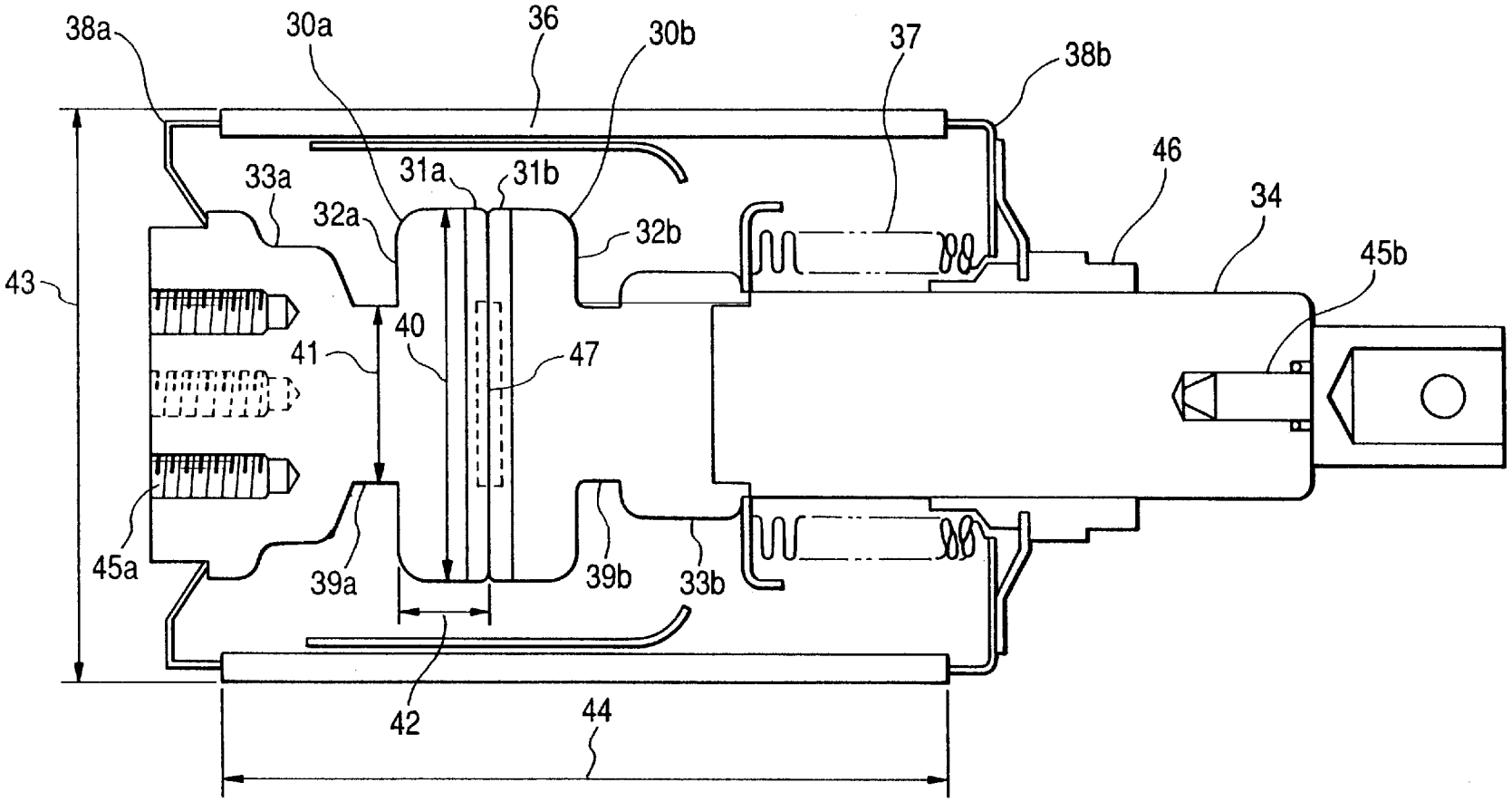
FIG. 9 is a sectional view of the vacuum bulb.

The fixed electrode and movable electrode, each of which has the above configuration, are disposed as shown in FIGS. 8 and 9. In this case, the current $i_1$ flowing in the electrodes is controlled to form a go-and-return current path substantially along the circumferential direction. An arc A generated between the electrodes is driven on the arc running faces in the circumferential direction of the electrodes by a magnetic field H generated at the time when the current $i_1$ flows in the go-and-return current path.

For example, when the arc A moving on the arc running face 5B reaches the boundary with the arc running face 5D, it must be shifted to the arc running face 5D through the communicating portion 14. In this case, however, the present inventors have found that the shunt current $i_2$ flowing on the arc running face 5D through the slit groove 13A obstructs the flow of the current $i_1$ from the arc running face 5B into the arc running face 5D, so that the arc 21 stays near the communicating portion 10, to cause local heating and fusion of the arc electrode, resulting in the impossible breaking function.

The present inventors have solved the above problem by adjusting the cross-section, for example, width, thickness and the like of the communicating portion 14 so as to control the flow of the current $i_1$ and shunt current $i_2$ into the communicating portion 14. That is, the width L of the communicating portion 14 was set such that the relationship $D_2/D_1$ is more than 0.9 and less than 1 where $D_1$ and $D_2$ are the outside diameter and the inside diameter of the communicating portion 14. This makes it possible to magnetically drive the arc A on the arc running faces in the circumferential direction of the electrodes, thereby significantly increasing the cutoff current capacity. For example, the cutoff current capacity of the electrode structure according to the present invention becomes twice that of the conventional electrode in which the width L of each communicating portion 14 is not adjusted. In other words, the electrode structure of the present invention can be reduced in size and weight as compared with the conventional electrode structure.

The reason the width L of the communicating portion 14 is set such that $D_2/D_1$ is more than 0.9 and less than 1 is as follows:, namely, when being 0.9 or less, the width L is excessively widened, so that the shunt current $i_2$ flows in an amount larger than that of the current $i_1$ and thereby the current $i_1$ stays near the communicating portion 14, resulting in the impossible breaking function; and when being 1 or more, the width L is excessively narrowed, so that the current $i_1$ excessively flows in the communicating portion 14 to generate an excessively large magnetic field H, with a result that the arc A jumps outward of the electrode structure by an electromagnetic force F and collides with a shield 10, to lose the function of the circuit breaker. For this reason, according to the present invention, by setting the width L of the communicating portion 14 such that the relationship $D_2/D_1$ is more than 0.9 and less than 1, the flow of the current $i_1$ and shunt current $i_2$ into the communicating portion 14 can be suitably controlled. In this case, it is advantageous to control the shunt current $i_2$ because control of the shunt current $i_2$ is easier in narrowing the width of the connecting portion 14 than control of the current $i_1$, to reduce the weight of the electrode structure, thereby achieving the above-described effects. In other words, the dimensions and weight of the electrode structure can be suitably designed in accordance with the magnitude of the cutoff current capacity only by adjusting the width L of the communicating portion 14. The communicating portion 14 is preferably adjusted in terms of the width L and thickness thereof. The fine adjustment of the width L of the communicating portion 14 can be visually performed by an operator. This makes easy the adjusting works and improves the working efficiency.

[Embodiment 2]

This embodiment is different from Embodiment 1 in that a preliminary sintering step is provided prior to the main sintering step. The preliminary sintering step was carried out in a vacuum of $1\times10^{-5}$ Torr or less at 300° C. being lower than the melting point of Pb for 120 min. The main sintering step was carried out in a vacuum of $1\times10^{-5}$ Torr or less at 1050° C. for 120 min. In the next filtration step, the porous sintered body 6 and the filtration Cu block serving as the member for forming the arc electrode supporting portion, back conductor and the external side connecting portion were held in a vacuum of $1\times10^{-5}$ Torr or less at 1050° C. for 60 min, so that the Cu block was melted to be homogeneously filtrated in the skeleton of the porous sintered body 6. The porous sintered body filtrated with Cu and the remaining Cu member were naturally cooled in a vacuum atmosphere to be solidified, and were cut in a shape as described in Embodiment. A boundary portion between the arc electrode 1 and arc electrode supporting portion 2 and a boundary portion between the arc electrode supporting portion 2 and the external side portion 3 were microscopically observed, which gave the result in which voids of the sintered body were filtrated with Cu and the boundary portion was metallographically integrally continuous. As a result of preparing samples by cutting the arc electrode 1 and analyzing Pb for each sample, it was revealed that the content of Pb was 0.7 wt %.

[Embodiment 3]

Figure 6:
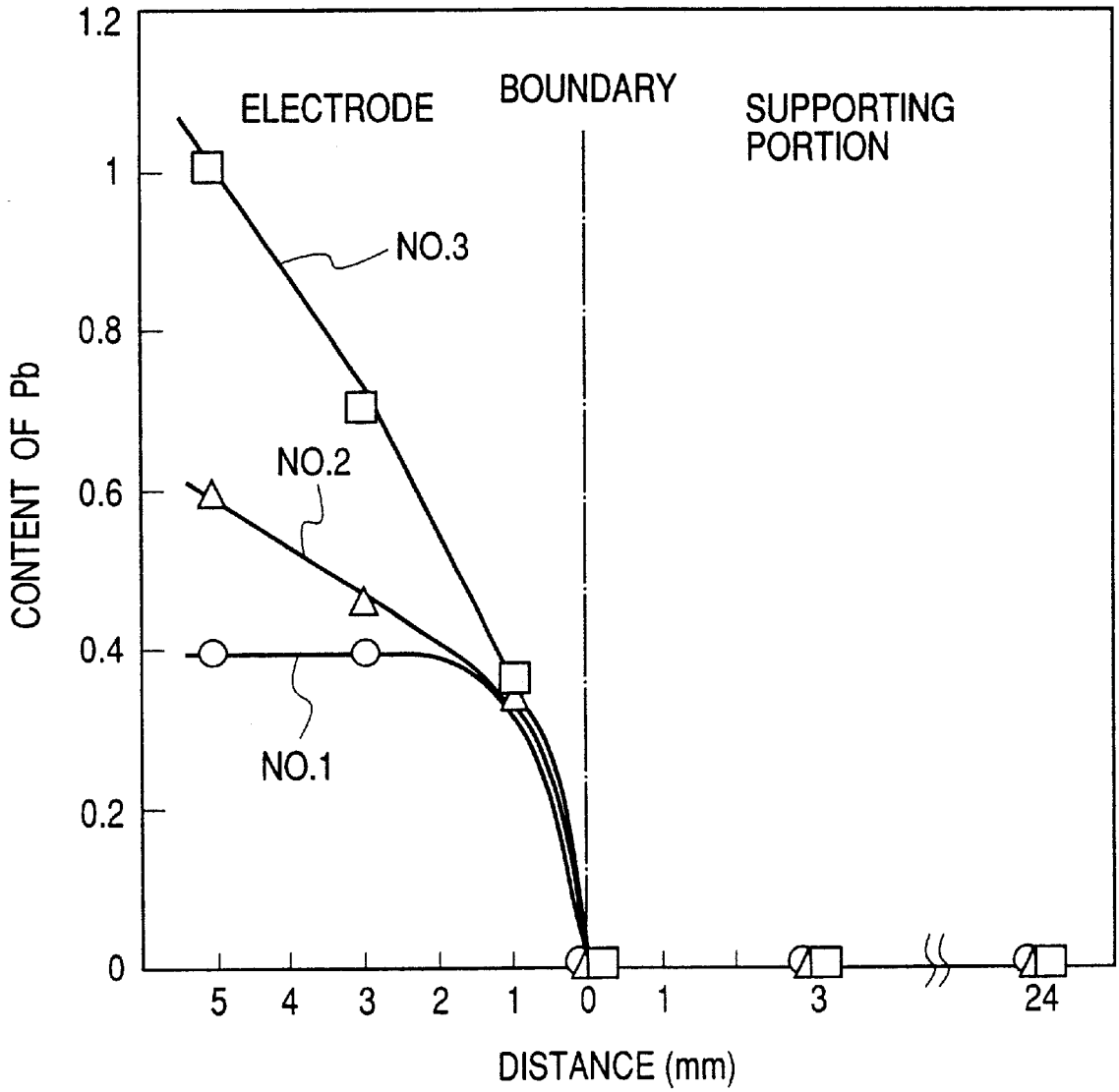
FIG. 6 is a graph showing a relationship between the content of Pb in a compact and a distribution of Pb in an arc electrode after filtration.

FIG. 6 is a graph showing a relationship between the content of Pb in a compact and a distribution of Pb in an arc electrode after filtration. In preparation of samples, the preliminary sintering condition, main sintering condition and filtrating condition are substantially the same as those in Embodiment 1. The compositions of the compacts are as follows: Sample No. 1 (50Cr—47.5Cu—2Nb—0.5Pb); Sample No. 2 (50Cr—47Cu—2Nb—1Pb); and Sample No. 3 (50Cr—46.5Cu—2Nb—1.5Pb).

The distribution of Pb in the arc electrode after filtration was measured by cutting the arc electrode each 1 mm in the depth direction from the boundary between the arc electrode and the arc electrode supporting portion to take each specimen for analysis, and analyzing the content of Pb contained in the specimen. As shown in FIG. 3, for each of Samples No. 2 (1% Pb) and No. 3 (1.5 Pb), the arc electrode has a gradient distribution of Pb. This means that the arc electrode in each of Samples Nos. 2 and 3 is not stable in material quality. On the other hand, for Sample No. 1 (0.5% Pb), the arc electrode has a nearly uniform distribution of Pb.

According to the method of the present invention, as described above, by use of a compact containing Pb in an amount of 0.5%, it is possible to obtain a stable arc electrode which exhibits a nearly uniform distribution of Pb.

The examination was made for other elements Bi, Te and Sb in the same manner as described above, which gave the result that the distribution of each of Bi, Te and Sb was similar to the distribution of Pb.

To obtain an ingot having a high material quality and a high dimensional stability, it is important to control a cooling rate of the ingot. In particular, it is required that the cooling rate in the cooling direction from top to bottom of the ingot is larger than that from a side surface to the center of the ingot. To increase the cooling rate in the cooling direction from top to bottom of an ingot, there may be used a heat reserving agent, for example, particles of a ceramic such as alumina ($Al_2O_3$) having a specific heat and not reacting with molten Cu. If the optimum particle size of ceramic particles is in a range of 20 mesh to 325 mesh. If the particle size is excessively larger or smaller than the above specific range, molten metal flows out through the ceramic particles. To achieve a good heat reserving effect, the ceramic particles may be put in a mold in an amount equivalent to a thickness being two-third or more of the diameter of the target ingot.

[Embodiment 4]

Figure 7:
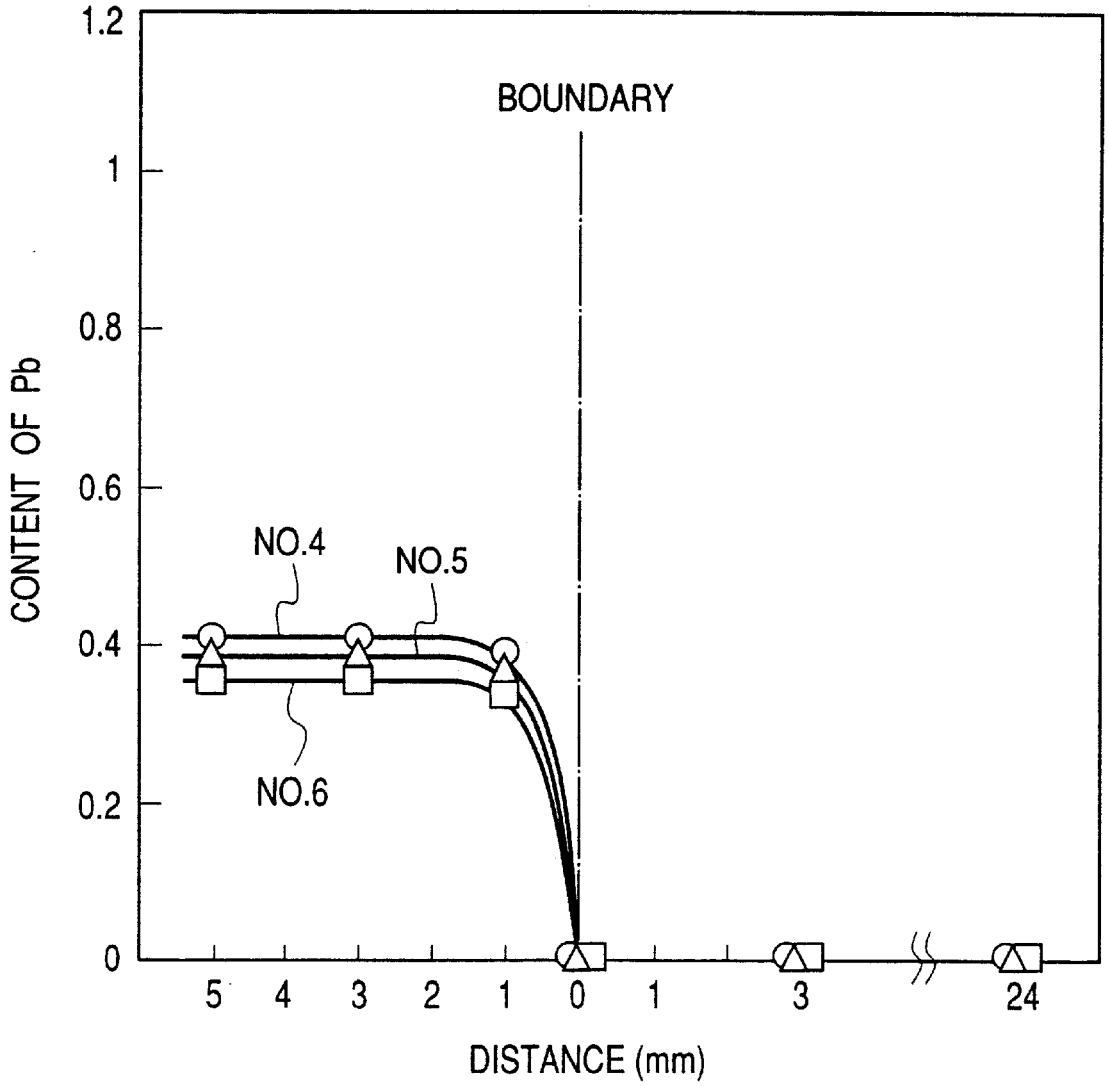
FIG. 7 is a graph showing a relationship between the content of Pb in the arc electrode and the filtration temperature.

FIG. 7 is a graph showing a relationship between the content of Pb in the arc electrode and the filtration temperature for the same samples as Sample No. 1 in Embodiment 3 except that the filtration temperature.

Sample Nos. 4, 5 and 6 were obtained by filtrating Cu in sintered bodies each having a composition of 50Cr—47.5Cu—2Nb—0.5Pb under filtration conditions of 1150° C. for 60 min, 1200° C. for 60 min, and 1250° C. for 60 min, respectively.

As is apparent from FIG. 7, the content of Pb is kept substantially constant with the filtration temperature varied in a range of 1150 to 1250° C. (strictly speaking, it becomes slightly smaller as the filtration temperature becomes higher).

Table 1 shows results of measuring an electric resistance and a strength of a brazed junction (thickness: about 3 $\mu$m of a test piece (Comparative Example 1) in which a pure Cu block is joined to an arc electrode (composition: 59 wt % Cr–41 wt % Cu) by a conventional brazing process (condition: 800° C., in vacuum, Ni based brazing filler metal); an electric resistance and a strength of a test piece (Comparative Example 2) in which a pure Cu block is annealed at 800° C.; and an electric resistance and a strength of a boundary at which an arc electrode is integrated with an arc electrode supporting portion by filtration for each of Samples Nos. 1 to 6. The electric resistance was measured by a four-point type resistance measuring method, and the strength was measured using an Amsler type testing machine.

TABLE 1

| | Electric resistance ($\mu\Omega\cdot$cm) | Result of tensile test (kg/mm$^2$) $\sigma_{0.2}$ (0.2% proof stress) | $\sigma_B$ (Maximum strength) |
|---|---|---|---|
| Comparative Example 1 | 4.82 | 4-5 | 8-22 |
| Comparative Example 2 | 1.73 | 4-5 | 12-15 |
| Comparative Example 3 | 3.42 | 10-11 | 24-25 |
| No. 1 | 3.41 | 6-7 | 23-24 |
| No. 2 | 3.40 | 6-7 | 20-21 |
| No. 3 | 3.41 | 9-10 | 18-19 |
| No. 5 | 3.40 | 9-10 | 23-24 |
| No. 6 | 3.40 | 9-10 | 21-22 |

For the test pieces (Comparative Example 1) in each of which the pure Cu block is joined to the arc electrode by the conventional brazing manner, the strength of the brazed junction largely varies in a range of 22 to 12 kg/mm$^2$ and particularly, the test piece having the strength of 12 kg/mm$^2$ exhibits a brazing failure; and the electric resistance of the test piece containing the junction is as high as 4.82 $\mu\Omega\cdot$cm which is higher about three or four times that of the test piece (Comparative Example 2) in which a pure Cu block is annealed. On the other hand, for the test pieces (Samples Nos. 1 to 6), the strength of the boundary between the arc electrode containing Pb and the arc electrode supporting portion is stable in a range of 23 to 24 kg/mm$^2$ being comparable with that of the test piece (Comparative Example 3) in which the arc electrode not containing Pb is integrated with the arc electrode supporting portion by filtration, and further no failure is observed. Further, the arc electrode supporting portion in each of Samples Nos. 1 to 6 exhibits, though it is made from a Cu containing above 0.62% of Cr, a specific resistance of 1.95 $\mu\Omega$·cm which is lower than that of the test piece (Comparative Example 1) in which the pure Cu block is brazed to the arc electrode. This is because the test piece (Samples Nos. 1 to 6) has no boundary between the arc electrode and the arc electrode supporting portion. Consequently, it is revealed that the resistance of the brazed junction of the test piece prepared by the conventional method exhibits a very large resistance.

For the test piece (Comparative Example 2) in which the pure Cu block is annealed, the maximum strength is in a range of 12 to 15 kg/mm$^2$; however, the 0.2% proof stress is as very small as a value in a range of 4 to 5 kg/mm$^2$. This means that an arc electrode supporting portion or the like formed of such a pure Cu block cannot withstand an impact load and may be deformed with age. On the other hand, for each of the test pieces (Sample Nos. 1 to 6), since the arc electrode supporting portion is made from a Cu alloy containing Cr, the maximum strength thereof is in a range of 22 to 25 kg/mm$^2$ which is about 2 times or more that of the pure Cu block and the 0.2% proof stress is in a range of 10 to 14 kg/mm$^2$ which is about 2 times that of the pure Cu block. For an arc electrode supporting portion made from a Cu alloy containing Ag, V, Nb, Si, W, or Be exhibits the same strength increasing effect as that for the arc electrode supporting portion made from the Cu alloy containing Pb.

Table 2 shows results of analyzing the contents of Pb in ingots for Sample No. 2 (as filtrated) in Example 2 in which the filtration temperature is varied, and results of analyzing compositions of ingots for samples in which compositions of a porous sintered body and an arc electrode supporting portion are varied. In addition, a riser 8 has the same composition as that of the Cu block for filtration.

Samples Nos. 11 to 13 were prepared by filtrating pure Cu in porous sintered bodies having Cr—5Cu based compositions at various filtration temperatures for 120 min. It is revealed that the ingot in which filtration is performed at a filtration temperature of 1250° C. becomes a Cu alloy containing Cr in an amount of 1.65%.

Sample Nos. 14, 15, 19, 20, 21 and 23 were prepared by filtrating filtrants composed of a Cu—Ag, Cu—Zr, Cu—Si and Cu—Be alloy in porous sintered bodies each having a Cr—5Cu based composition. It is revealed that each of ingots in Samples Nos. 14, 15, 19, 20, 21 and 23 becomes a Cu-based ternary alloy containing Cr in an amount of about 0.6%.

Sample Nos. 16, 17, 18 and 22 were prepared by filtrating a filtrant composed of pure Cu in porous sintered bodies having Cr—5Cu based compositions added with V, Nb, V, Nb and W. It is revealed that each of ingots in Sample Nos. 16, 17, 18 and 22 becomes a Cu alloy containing Cr in an amount of about 1.0% and V, Nb and W in a total amount of 0.02% or less.

TABLE 2

| | Composition (wt %) | | | Infiltrant | Analysis result (wt %) | | | | | | | | |
|---|---|---|---|---|---|---|---|---|---|---|---|---|---|
| No. | Sintered Body | Arc electrode material | Infiltrant | temperature (° C.) | Cr | Ag | V | Nb | Zr | Si | W | Be | Others |
| 11 | Cu—5Cu—0.5Pb | 61Cr—39Cu—0.5Pb | Cu | 1150 | 0.62 | — | — | — | — | — | — | — | Pb 0.7 |
| 12 | Cr—5Cu—0.5Pb | 61.3Cr—38.7Cu—0.5Pb | Cu | 1200 | 0.98 | — | — | — | — | — | — | — | Pb 0.7 |
| 13 | Cr—5Cu—0.5Bi | 60Cr—40Cu—0.5Bi | Cu | 1250 | 1.65 | — | — | — | — | — | — | — | Bi 0.7 |
| 14 | Cr—5Cu—0.5Pb | 60.7Cr—39.2Cu—0.002Ag—0.5Pb | Cu—0.5Ag | 1150 | 0.67 | 0.46 | — | — | — | — | — | — | Pb 0.7 |
| 15 | Cr—5Cu—0.5Pb | 60.2Cr—39.7Cu—0.004Ag—0.5Pb | Cu—1.0Ag | 1150 | 0.60 | 0.97 | — | — | — | — | — | — | Pb 0.7 |
| 16 | Cr—5Cu—3V—0.5Pb | 60.7Cr—37.4Cu—1.90V—0.5Pb | Cu | 1200 | 0.92 | — | 0.02 | — | — | — | — | — | Pb 0.7 |
| 17 | Cr—5Cu—3Nb—0.5Pb | 61.0Cr—37.1Cu—1.91Nb—0.5Pb | Cu | 1200 | 0.90 | — | — | 0.01 | — | — | — | — | Pb 0.7 |
| 18 | Cr—5Cu—3V—3Nb—0.5Pb | 59.7Cr—36.49cu—1.87V—1.94Nb—0.5Bi | Cu | 1200 | 0.97 | — | 0.01 | 0.01 | — | — | — | — | Bi 0.7 |
| 19 | Cr—5Cu—0.5Pb | 61.2Cr—38.8Cu—0.003Zr—0.5Pb | Cu—0.5Zr | 1150 | 0.68 | — | — | — | 0.41 | — | — | — | Pb 0.7 |
| 20 | Cr—5Cu—0.5Pb | 60.8Cr—39.2Cu—0.005Zr—0.5Pb | Cu—0.1Zr | 1150 | 0.64 | — | — | — | 0.81 | — | — | — | Pb 0.7 |
| 21 | Cr—5Cu—0.5Bi | 61.2Cr—38.8Cu—0.004si—0.5Bi | Cu—0.5Si | 1150 | 0.61 | — | — | — | — | 0.39 | — | — | Bi 0.7 |
| 22 | Cr—5Cu—5W—0.5Bi | 58.1Cr—38.7Cu—3.2W—0.5Bi | Cu | 1200 | 0.90 | — | — | — | — | — | 0.01 | — | Bi 0.7 |
| 23 | Cr—5Cu—0.5Pb | 60.7Cr—39.3Cu—0.5Pb | Cu—0.1Be | 1200 | 0.89 | — | — | — | — | — | — | 0.08 | Pb 0.7 |

For each of test pieces (Sample Nos. 11 to 23), the electric resistance was measured by the four-point type resistance measuring method and the strength was measured using the Amsler type testing machine.

For the test pieces in which the brazing is performed by a conventional brazing manner, the strength of the brazed junction largely varies in a range of 22 to 12 kg/mm$^2$ and particularly, the test piece having the strength of 12 kg/mm$^2$ exhibits a brazing failure; and the electric resistance of the test piece containing the junction is as high as 4.82 $\mu\Omega$·cm which is higher about three or four times that of the test piece (Comparative Example 2) in which a pure Cu block is annealed. On the other hand, for the test piece (Samples No. 11), the strength of the boundary is stable in a range of 24 to 25 kg/mm$^2$, and further no failure is observed. In addition, for the test pieces of the present invention, the electric resistance of the boundary cannot be measured. The arc electrode supporting portion in Sample No. 11, which is made from a Cu alloy containing Cr in an amount of 0.62%, exhibits a specific resistance of 1.95 $\mu\Omega$·cm. This is because the test piece has no boundary between the arc electrode and the arc electrode supporting portion. As a result, it is revealed that the resistance of the brazed junction of the test piece prepared by the conventional method exhibits a very large resistance.

For the pure Cu block, the maximum strength is in a range of 22 to 23 kg/mm$^2$; however, the 0.2% proof stress is as very small as a value in a range of 4 to 5 kg/mm$^2$. This means that an arc electrode supporting portion or the like formed of such a pure Cu block cannot withstand an impact load and may be deformed with age. On the other hand, for each of the test pieces (Sample Nos. 12 to 23), since the arc electrode supporting portion is made from a Cu alloy containing Cr, Ag, V, Nb, Zr, Si, W or Be, the electric resistance is as low as being about 1.5 to 2.0 times that of the annealed pure Cu block, but is about a half or less that of the brazed boundary of the sample in which brazing is performed by the conventional brazing manner, and therefore, such an electric resistance allows each of Sample Nos. 12 to 23 to be sufficiently used as electrode materials for actual vacuum circuit breakers. Also, for each of the test pieces (Sample Nos. 12 to 23), the maximum strength is in a range of 22 to 25 kg/mm$^2$ which is different only a little from that of the pure Cu block and the 0.2% proof stress is in a range of 10 to 14 kg/mm$^2$ which is twice that of the pure Cu block.

The dissolved amount in solid of Cr becomes larger as the filtration temperature becomes higher, for example, 0.55 to 0.75% at 1150° C.; 0.9 to 1.0% at 1200° C.; and 1.6 to 1.7% at 1250° C.

As described above, the member composed of the arc electrode supporting portion, back conductor, and external side connecting portion according to the present invention, which is made from a Cu alloy containing Cr or Ag, V, Nb, Zr, Si, W and Be, is not deformed when applied with the repeated impact load upon opening/closing of the electrodes. As a result, the above member prevents fusion failure due to deformation thereof, resulting in the improved reliability and safety.

A relationship between the contents of alloying elements in Cu and 0.2% proof stress for the Cu alloy forming the member composed of the arc electrode supporting portion, back conductor and external side connecting portion will be examined below. The proof stress of the Cu alloy is increased linearly with the increased content of Cr. For example, the Cu alloy containing Cr in an amount of 0.6% exhibits a proof stress of 9 kg/mm$^2$, and the Cu alloy containing Cr in an amount of 1.6% exhibits a proof stress of 11.5 kg/mm$^2$. Further, the proof stress of the Cu alloy is increased with the increased amounts of alloy elements other than Cr. For example, the Cu alloy containing 0.1% of Ag, 0.1% of Zr, 0.1% of Si, 0.05% of Be, and 0.01% or more of Nb, V and W exhibits a proof stress of 10 kg/mm$^2$ or more.

A relationship between the specific resistance and 0.2% proof stress for the Cu alloy forming the member composed of the arc electrode supporting portion, back conductor and external side connecting portion will be examined below. When the total solid-solution amount of Cr in Cu is increased, not only the strength but also the specific resistance of the Cu alloy is increased. To improve the strength of the Cu alloy while suppressing the increased specific resistance thereof, elements other than Cr may be added to the Cu alloy. In particular, elements other than Si are effective to increase the strength of the Cu alloy suppressing the increased specific resistance thereof. The Cu alloy forming the member composed of the arc electrode supporting portion, back conductor and external side connecting portion, preferably, has a 0.2% proof stress in a range of 10 kg/mm$^2$ or more and a specific resistance in a range of 1.9 to 2.8 $\mu\Omega$·cm.

A relationship between the amounts of Cr, Si, Be, Zr, Ag, Nb, V and W and the specific resistance for the Cu alloy forming the member composed of the arc electrode supporting portion, back conductor and external side connecting portion will be described below. When the alloying elements are added to the Cu alloy in a ratio of [Cr+3.4Si+3.5Be+1.2Zr+0.6Ag+15 (Nb+V+W), the specific resistance of the Cu alloy is increased in proportion to a value (0.57×the total content+1.61). In the member composed of the arc electrode supporting portion, back conductor and external side connecting portion, the specific resistance may be set at a value being as small as possible for suppressing the temperature of the electrodes during current-carrying. In addition, the heat conductivity of the member is preferably kept at a high value for cooling heat caused by arc generated upon breaking operation through the electrode rod. In this embodiment, a desired specific resistance can be given to the Cu alloy. In the case of an arc electrode made from a Cr based alloy, the Cr alloy preferably contains 0.5% of Si, 0.5% of Be, 1.5% of Zr, 2.5% of Ag, 0.1% or less of Nb, 0.1% or less of V, and 0.1% or less of W in consideration of filtrated amount of Cr. The specific resistance is preferably in a range of 3.0 $\mu\Omega$·cm or less.

[Embodiment 5]

Table 3 shows data of a vacuum bulb in accordance with various ratings. Each of a fixed electrode and a movable electrode in each vacuum bulb of this embodiment is similar in composition and manufacture to that in each of Embodiments 1 to 4.

FIG. 8 is a sectional view of Vacuum Bulb No. 1, and FIG. 9 is a sectional view of Vacuum Bulb No. 4.

As shown in Table 3, the diameter of the back conductor can be made as thin as a half or less of the diameter of the electrode; for example, it can be set at a value being 0.35 to 0.50 times, more specifically, 0.38 to 0.47 times the diameter of the electrode. In this embodiment, since the arc electrode is integrated with the arc electrode supporting portion not by use of a brazing material but by filtration, a gap between the arc electrode and the insulating cylinder can be made as small as a value in a range of 10 to 15 mm. As a result, the vacuum bulb can be made compact.

TABLE 3

| Items | | No. 1 | 2 | 3 | 4 | 5 | 6 | 7 | 8 | 9 | 10 |
|---|---|---|---|---|---|---|---|---|---|---|---|
| Rating | Current (A) | 600 | 600 | 1200 | 2000 | 3000 | 3000 | 600 | 1200 | 2000 | 1250 |
| | Voltage (kV) | 7.2 | 7.2 | 7.2 | 7.2 | 7.2 | 15 | 12 | 7.2 | 24 | 25 |
| | Effective value of cutoff current (kA) | 12.5 | 20 | 31.5 | 40 | 63 | 50 | 16 | 31.5 | 25 | 25 |
| | Effective value of cutoff current × cutoff voltage (× $10^3$ kVA) | 90 | 142 | 226.8 | 288 | 453.6 | 750 | 192 | 226.8 | 600 | 625 |
| Insulating cylinder | Outside diameter (mm) | 62 | 72 | 90 | 100 | 130 | 130 | 72 | 90 | 100 | 110 |
| | Length (mm) | 100 | 100 | 130 | 130 | 215 | 215 | 130 | 170 | 215 | 238 |
| Back conductor | Electrode back conductor diameter (mm) | 15 | 16 | 22 | 30 | 38 | 38 | 16 | 22 | 26 | 30 |
| Electrode main body | Diameter (mm) | 32 | 42 | 57 | 66 | 86 | 86 | 39 | 57 | 66 | 66 |
| | Thickness (mm) | 8 | 9 | 10 | 15 | 17 | 17 | 9 | 10 | 10 | — |
| | Diameter of recess (mm) | 15 | 16 | 22 | 30 | 38 | 38 | 16 | 22 | 26 | 30 |
| | Depth of recess (mm) | 1 | 1 | 2 | 2 | 3 | 3 | 1 | 2 | 2 | — |
| Number of spiral grooves | | 3 | 3 | 3 | 4 | 6 | 6 | 3 | 3 | 3 | 4 |
| Width of spiral groove (mm) | | 2 | 2 | 2 | 2.5 | 3 | 3 | 2 | 2 | 2 | 2 |

A vacuum vessel has a vacuum chamber in which a pair of upper and lower seal rings 38*a* and 38*b* are respectively provided on upper and lower opening portions of an insulating cylinder 35 made from an insulating material. A fixed electrode 30*a* is hung from an intermediate portion of the seal ring 38*a,* and a movable side electrode rod 34 constituting part of a movable electrode 30*b* is liftably provided at an intermediate portion of the seal ring 38*b.* An expandable metal bellows 37 for allowing an arc electrode 31*b* of the movable electrode 30*b* to be close to or apart from an arc electrode 31*a* of the fixed electrode 30*a* is provided inside the seal ring 38*b* in such a manner as to surround the movable side electrode rod 34. A seal member 36 formed of a cylindrical metal plate is disposed inside the insulating cylinder 35 constituting the vacuum vessel in such a manner as to surround both the arc electrodes 31*a* and 31*b.* The seal member 36 is provided in such a manner as not to obstruct insulation of the insulating cylinder 35 constituting the vacuum vessel. The electrode rod 34 is joined to the movable electrode 30*b* by brazing.

The arc electrode 31*a* (or 31*b*) is integrated with a member, which is composed of an arc electrode supporting portion 32*a* (32*b*), an external side connecting portion 33*a* (or 33*b*) to be connected to an external conductor, and a back conductor 39*a* (39*b*), by the above-described filtration. The insulating cylinder 35 constituting the vacuum vessel is formed of a sintered body made from glass or ceramic. The insulating cylinder 35 is brazed to the seal rings 38*a* and 38*b* through an alloy sheet having a thermal expansion coefficient being similar to that of glass or ceramic such as a cover sheet in such a manner as to be kept at a high vacuum of $10^{-6}$ mmHg or less.

The external side connecting portions 33*a* and 33*b* of the fixed and movable electrodes are respectively provided with threaded portions 45*a* and 45*b* to be connected to external terminals, to form current flow paths from and to the exterior. An exhaust pipe (not sown) is provided on the seal ring 38*a,* which pipe is connected to a vacuum pump when the vacuum vessel is evacuated. A getter is provided to absorb a trace amount of gas generated in the vacuum vessel and to keep constant the vacuum state. The seal member 36 acts to allow metal vapor generated by arc on the surface of the main electrode to be stuck thereon and to be cooled. The metal stuck on the seal member 36 has a function as a getter for holding the vacuum degree.

In FIG. 8, with respect to dimensions of the electrode, reference numeral 43 indicates the outside diameter of the insulating cylinder; 44 is the length of the insulating cylinder; 41 is the diameter of the back conductor; 40 is the diameter of the electrode main body; and 42 is the thickness of the electrode. Reference numeral 46 indicates a guide and 47 is a button formed into a complete round recess having a desired depth. The button 47 is the same as the recess 5A shown in FIG. 5.

As shown in Table 3, in the vacuum bulb of the present invention, the outside diameter and length of the insulating cylinder, diameter of the back conductor, diameter and length of the electrode main body, diameter and depth of the recess, and the number and shape of spiral grooves vary depending on a difference in rating breaking capacity.

Figure 10:
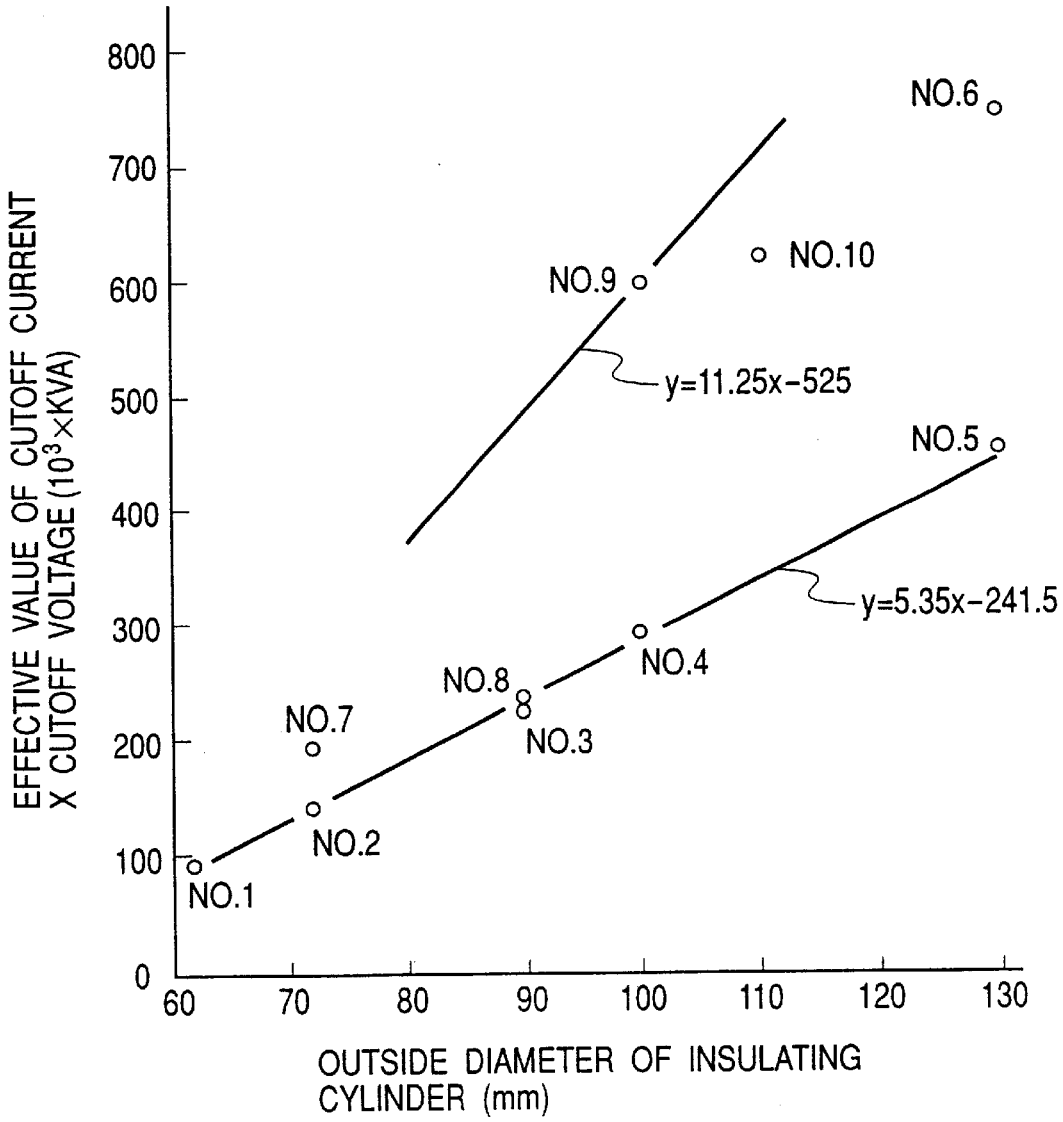
FIG. 10 is a graph showing a relationship between an effective value of cutoff current×cutoff voltage and an outside diameter of an insulating cylinder.

FIG. 10 is a graph showing a relationship between an effective value of cutoff current kA×cutoff voltage kV (y) and the outside diameter (x) of the insulating cylinder. As shown in FIG. 10, the effective value of cutoff current×cutoff voltage (y) is preferably set in a range between a value obtained from y=11.25x−525 and a value obtained from y=5.35x−241.5.

Figure 11:
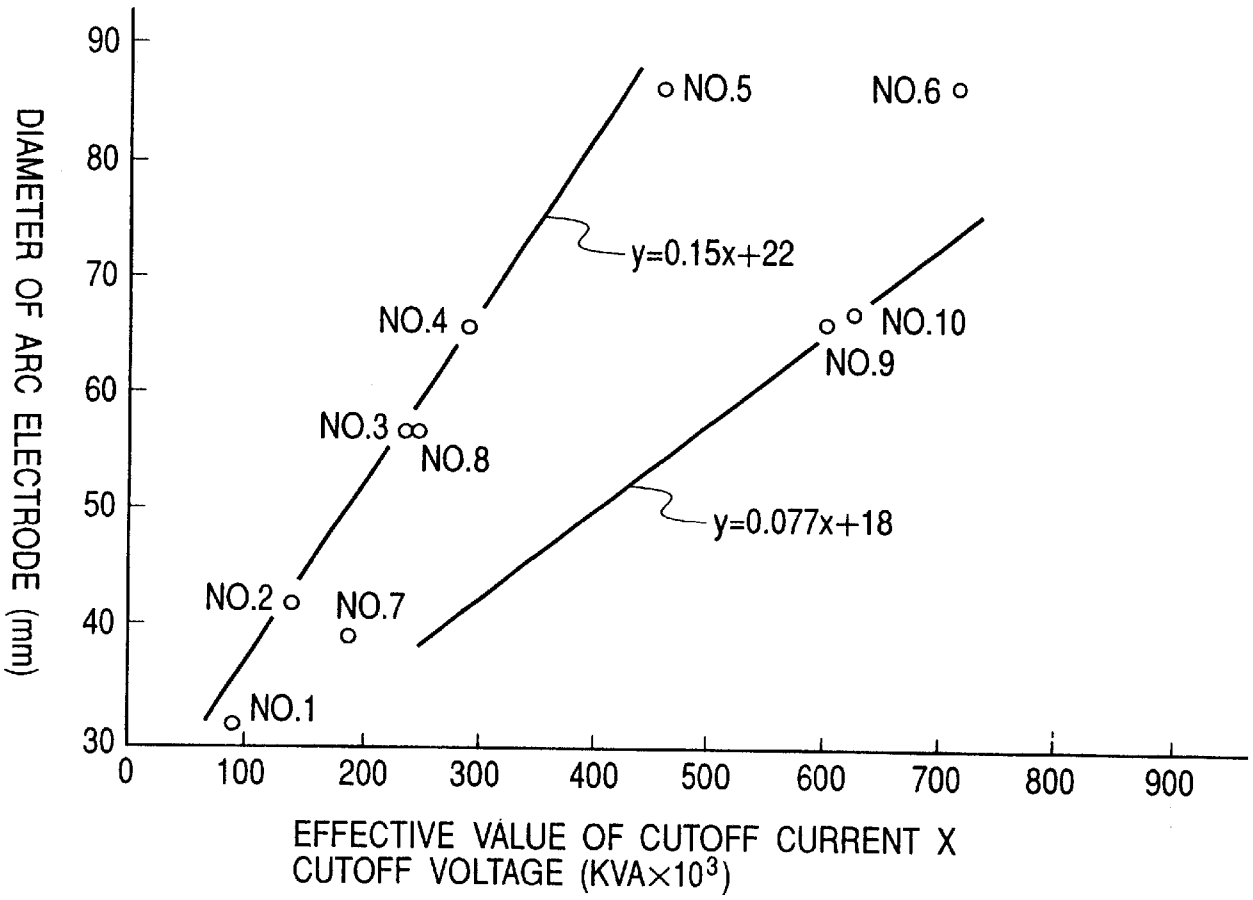
FIG. 11 is a graph showing a relationship between a diameter of an arc electrode and an effective value of cutoff current×cutoff voltage.

FIG. 11 is a graph showing a relationship between the outside diameter (y, mm) of the arc electrode and an effective value of cutoff current×cutoff voltage (x, ×$10^3$ kVA). As shown in FIG. 11, the diameter (y) of the arc electrode is preferably set in a range between a value obtained from y=0.15x+22 and a value obtained from y=0.077x+18.

Figure 12:
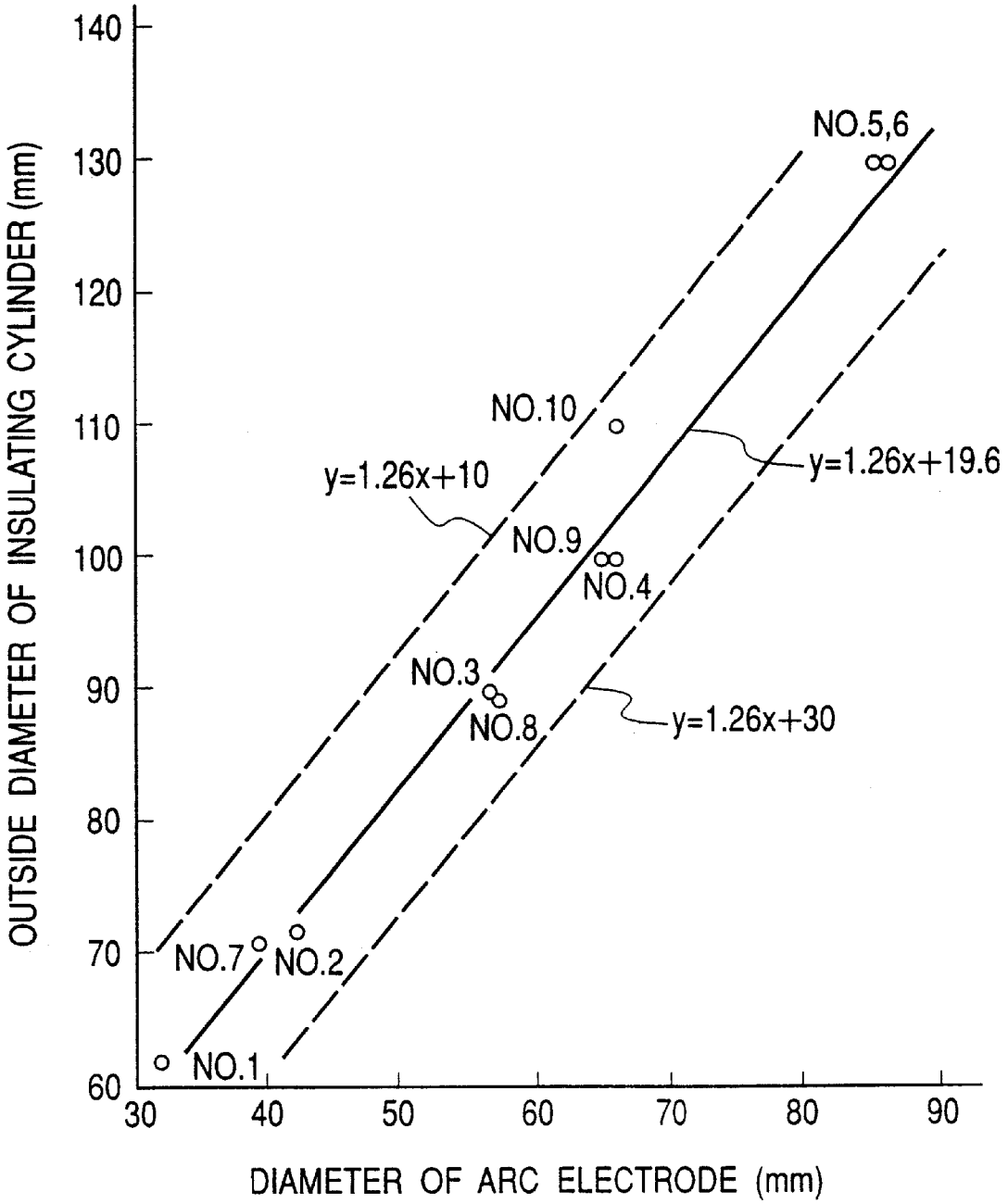
FIG. 12 is a graph showing a relationship between an outside diameter of the insulating cylinder and a diameter of the arc electrode.

FIG. 12 is a graph showing a relationship between the outside diameter (y) of the insulating cylinder and the diameter (x) of the arc electrode. The outside diameter (y) of the insulating cylinder is preferably set in a range between a value obtained from y=1.26x+10 and a value obtained from y=1.26x+30. In this embodiment, the outside diameter of the insulating cylinder is substantially set at a value obtained from y=1.26x+19.6.

Figure 13:
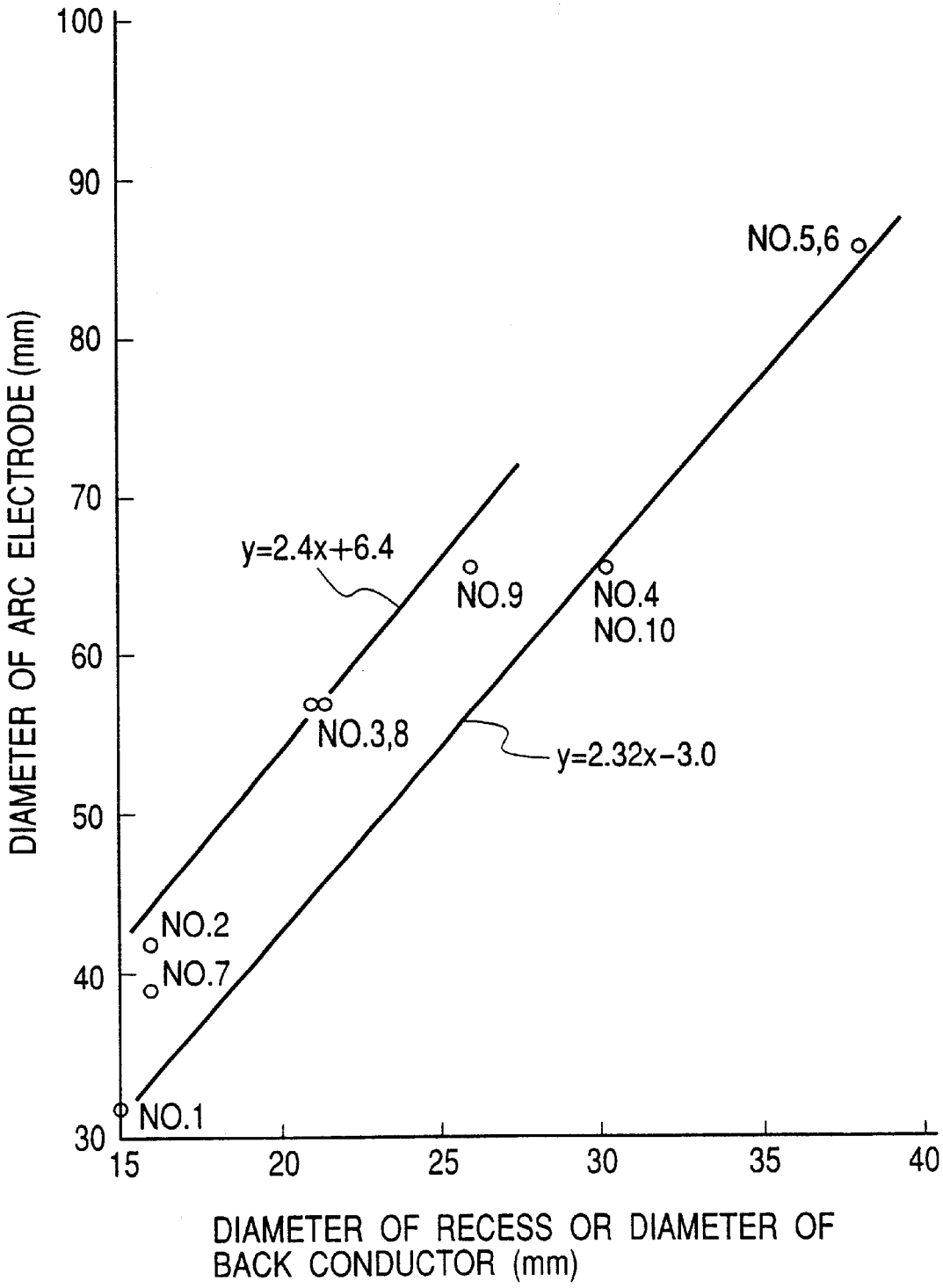
FIG. 13 is a graph showing a relationship between a diameter of an arc electrode and a diameter of a recess or a diameter of a back conductor.

FIG. 13 is a graph showing a relationship between the diameter (y) of the arc electrode and the diameter (x) of the recess or the diameter (x) of the back conductor. The diameter (y) of the arc electrode is preferably set in a range between a value obtained from y=2.4x+6.4 and a value obtained from y=2.32x−3.0.

Table 4 shows results of testing performances of various electrodes (diameter: 20 mm) each having an integral structure obtained by filtration as shown in FIG. 3. The electrode structure in this test has a button formed at the central portion of the electrode shown in FIG. 3. As the content of Cr becomes smaller, the withstand voltage characteristic becomes lower but the cutoff current effective value as the breaking performance becomes higher. The addition of Nb and Pb is effective to increase both the withstand voltage characteristic and the cutoff current effective value. According to the present invention, further, by provision of spiral grooves, a higher performance can be obtained. The spiral grooves are regularly provided at equal intervals.

TABLE 4

| No. | Electrode material (composition wt %) | Withstand voltage characteristic (kv/2.5mm) 0 50 100 150 | Cutoff performance (kA) 0 5 10 15 | Electric conductivity (IACS %) |
|---|---|---|---|---|
| 1 | Cu-80Cr | | | 21 |
| 2 | Cu-60Cr | | | 31 |
| 3 | Cu-40Cr | | | 40 |
| 4 | Cu-20Cr | | | 60 |
| 5 | Cu-60Cr-5Nb | | | 28 |
| 6 | Cu-39Cr-1Nb | | | 39 |
| 7 | Cu-39Cr-1.3Nb-0.3Pb | | | 39 |

Figure 14:
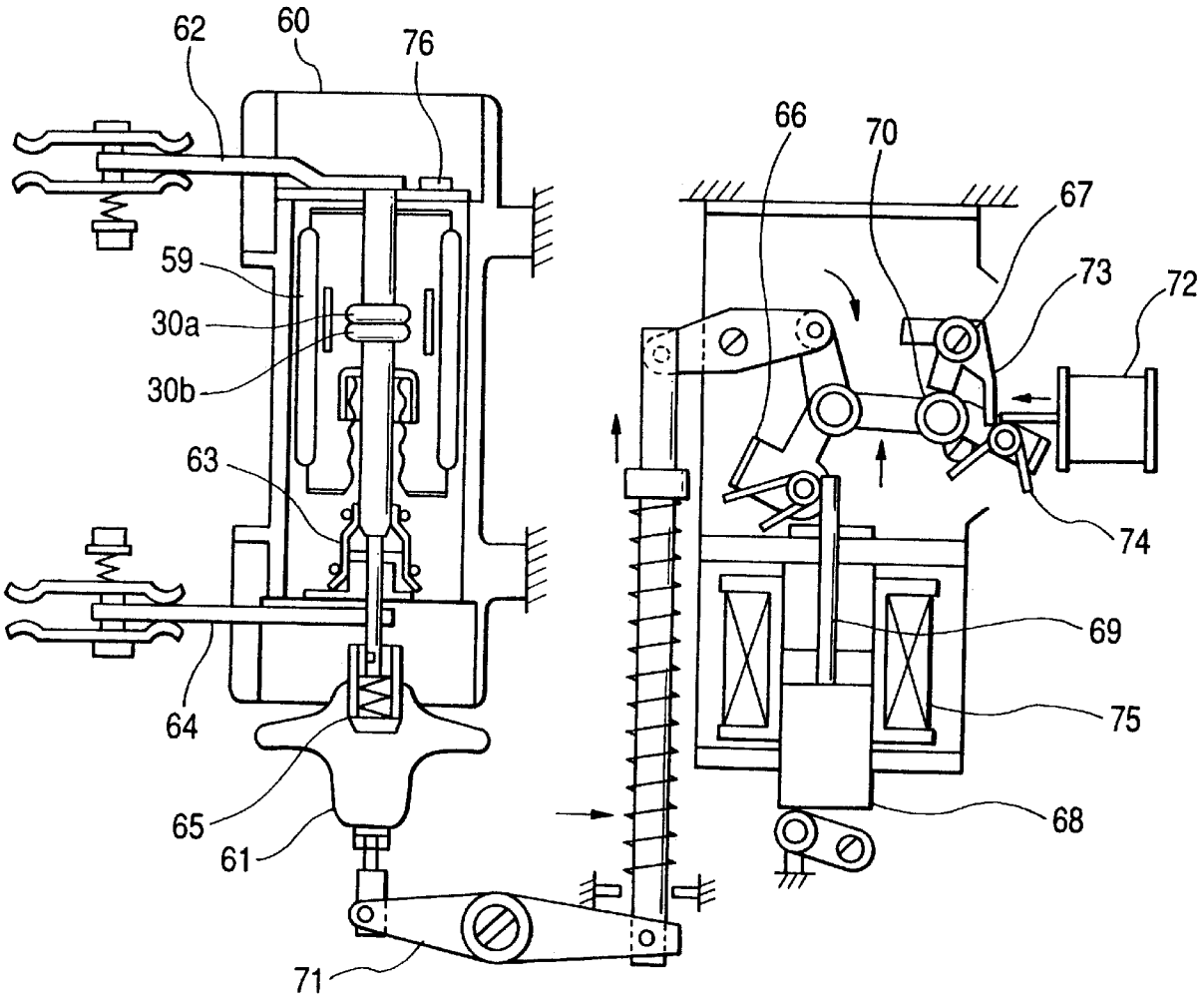
FIG. 14 is a view showing the entire configuration of a vacuum circuit breaker.

FIG. 14 is a configuration view of a vacuum circuit breaker, showing a vacuum bulb 59 of the present invention and a mechanism for operating the vacuum bulb 59. The vacuum breaker has a small-sized and lightweight structure in which the operating mechanism is disposed on a front side and three sets of three-phase batch type epoxy resin cylinders 60 having a tracking resistance for supporting the vacuum bulbs are disposed on a rear side.

The structure is of a horizontal drawing type in which each phase end is horizontally supported by the epoxy resin cylinder and a vacuum bulb supporting plate. The vacuum bulb is opened/closed by the operating mechanism through an insulating operating rod 61.

The operating mechanism is a simple, small-sized and lightweight mechanical trip-free mechanism of an electromagnetic operation type. This operating mechanism is applied with less impact because of a small opening/closing stroke and a small mass of a movable portion. On the front surface of the main body are disposed not only a manually connected secondary terminal but also an opening/closing indicator, operational number counter, manual trip button, manual charging device, drawer, interlock lever and the like.

(a) Closed Circuit State

In the closed circuit state of the breaker, a current flows from an upper terminal 62 to a lower terminal 64 through main electrodes 30 and a collector 63. The contact force between the main electrodes 30 is held by a contact spring 65 mounted on the insulating operating rod 61.

The contact force between the main electrodes, the force of a quick-break spring, and an electromagnetic force due to short-circuit are held by a supporting lever 66 and a prop 67. When the input coil is excited, the plunger 68 pushes up a roller 70 through a knocking rod 69 from the opened circuit state, so that a main lever 71 is turned to close the contacts. And, such a state is held by the supporting lever 66.

(b) Trip-free State

The movable main electrode is moved down by opening/separating operation, and arc is generated at the moment the movable main electrode is opened/separated from the fixed main electrode. The arc is extinguished for a short time by a high dielectric strength in vacuum and a high diffusion action of arc in vacuum.

When a trip coil 72 is excited, a trip lever 73 is disengaged from the prop 67 and the main lever 71 is turned by the quick-break spring to open the main electrodes from each other. This operation is performed independently from the presence or absence of the circuit closing operation, that is, performed in accordance with the mechanical trip-free manner.

(c) Opened Circuit State

After the main electrodes are opened, a link is returned by a reset spring 74 and simultaneously the prop 67 is engaged. By exciting the input coil 75 in such a state, the closed circuit state (a) is obtained. Reference numeral 76 indicates an exhaust cylinder.

Figure 15:
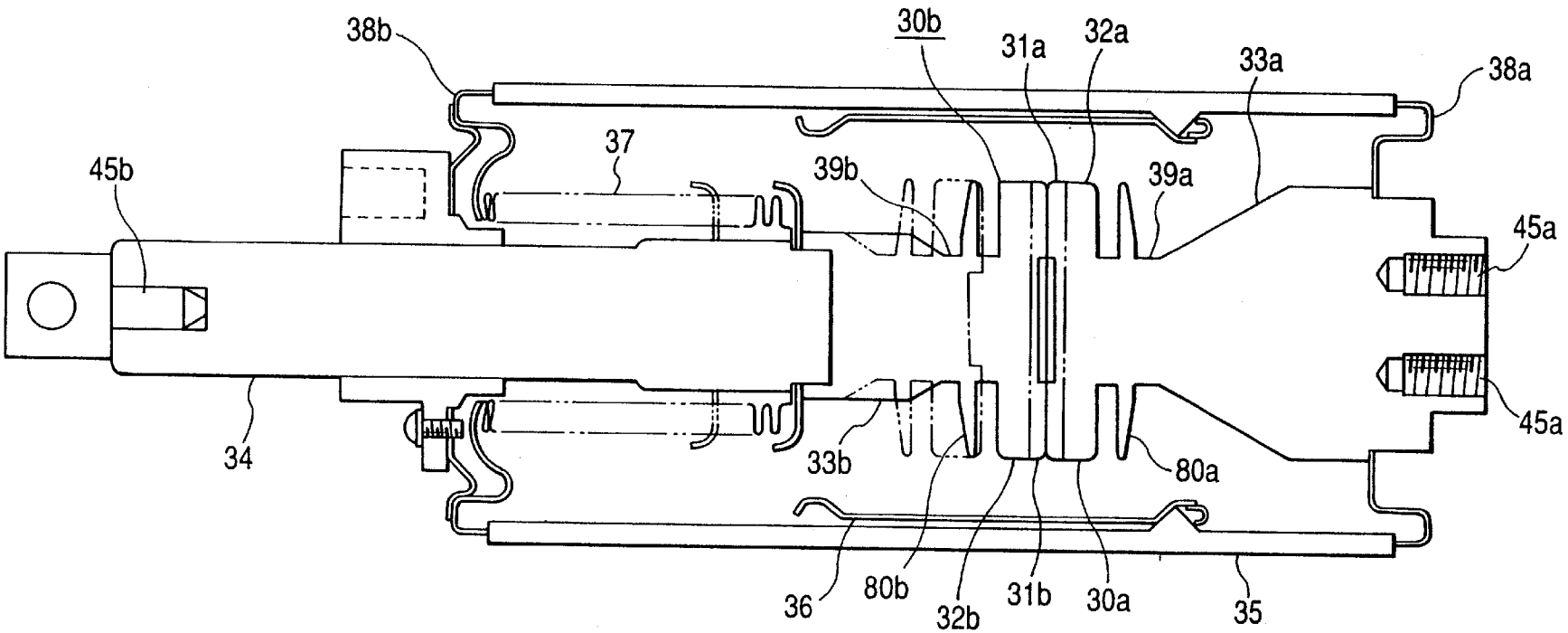
FIG. 15 is a sectional view of a vacuum bulb.

FIG. 15 is a sectional view of Vacuum Bulb No. 10 shown in Table 3. The structure of this vacuum bulb is quite different from those shown in FIGS. 8 and 9 in that fins 80*a* and 80*b* are respectively provided on the back conductors 39*a* and 39*b* of the fixed electrode 30*a* and the movable electrode 30*b* of the vacuum bulb electrode. The other structure is the same as those shown in FIGS. 8 and 9. Even in the structure shown in FIG. 15, the spiral slit grooves are provided in the electrode facing surfaces in such a manner as to pass through the arc electrode and the arc supporting portion, and such a structure enables the current breaking shown in Table 3. In the figure, for the movable electrode 30*b*, the current-carrying state is shown by a solid line, and the breaking state is shown in a two dotted chain line. The electrode rod 34 is joined to the movable electrode 30*b* by brazing.

What is claimed is:

1. A vacuum bulb comprising:

a fixed electrode and a movable electrode provided in a vacuum vessel, wherein each of said fixed electrode and said movable electrode comprises:

an arc electrode formed of a composite member containing particles of a refractory metal material and a highly conductive metal material; and an electrode supporting portion, made from said highly conductive metal material, for supporting said arc electrode;

wherein said arc electrode and said electrode supporting portion are formed integrally with each other by melting of said highly conductive metal material;

said insulating vessel is formed into a cylindrical shape; and an outside diameter y (mm) of said insulating vessel is in a range not more than a value obtained by an equation (5) and not less than a value obtained by an equation (6):

$$y=1.26x+10 \quad (5)$$

$$y=1.26x+30 \quad (6)$$

where x (mm) is a diameter of said arc electrode.

2. A vacuum bulb according to claim 1 further comprising:

a back conductor having a diameter smaller than that of said electrode supporting portion; and an external side connecting portion to be connected to an external conductor, said external side connecting portion having a diameter larger than that of said back conductor;

said back conductor, and said external side connecting portion also being formed integrally with each other and said arc electrode and said electrode supporting portion by means of said highly conductive metal material.

3. A vacuum circuit breaker comprising:

a vacuum bulb as claimed in claim 2;

terminals for connecting external conductors to said fixed electrode and said movable electrode; and an opening/closing means for driving said movable electrode.

4. A vacuum circuit breaker according to claim 3, wherein said refractory metal material is one kind or a mixture of two kinds or more selected from a group consisting of Cr, W, Mo and Ta; said highly conductive metal material is one kind or an alloy mainly containing one kind selected from a group consisting of Cu, Ag and Au; and said electrode supporting portion is made from said highly conductive metal material or an alloy containing said highly conductive metal material.

5. A vacuum circuit breaker according to claim 4, wherein said arc electrode is made from a composite alloy containing one kind or two kinds or more selected from a group consisting of Cr, W, Mo and Ta in a total amount of 20 to 80 wt %, and Cu in an amount of 20 to 80 wt %; and each of said electrode supporting portion, said back conductor, and said external side connecting portion is made from an alloy containing one kind or two kinds or more selected from a group consisting of Cr, Ag, W, V, Nb, Mo, Ta, Zr, Si, Be, Co, and Fe in a total amount of 2.5 wt % or less, and Cu, Ag or Au.

6. A vacuum circuit breaker according to claim 3, wherein said arc electrodes of said fixed electrode and said movable electrode, which are to be brought in contact with each other, each have at its central portion a recess formed into a complete round shape.

7. A vacuum circuit breaker according to claim 3, wherein said arc electrode, said electrode supporting portion, said back conductor, and said external side connecting portion are formed integrally with each other by melting and solidification of said highly conductive metal material.

8. A vacuum circuit breaker according to claim 6, wherein a plurality of slits are provided in said arc electrode and said electrode supporting portion.

9. A vacuum circuit breaker according to claim 3, wherein three sets of said vacuum bulbs are horizontally arranged and integrally assembled in a resin made insulating cylinder.

10. A vacuum circuit breaker comprising:

a vacuum bulb having a fixed electrode and a movable electrode disposed in a vacuum vessel;

terminals for connecting external conductors to said fixed electrode and said movable electrode; and an opening/closing means for driving said movable electrode;

each of said fixed electrode and said movable electrode comprising:

an arc electrode made from an alloy containing particles of a refractory metal material and a highly conductive metal material; and an electrode supporting portion, made from said highly conductive metal material, for supporting said arc electrode;

wherein said arc electrode and said electrode supporting portion are formed integrally with each other by means of said highly conductive metal material;

said insulating vessel is formed into a cylindrical shape; and an outside diameter y (mm) of said insulating vessel is in a range not more than a value obtained by an equation (5) and not less than a value obtained by an equation (6):

$$y=1.26x+10 \quad (5)$$

$$y=1.26x+30 \quad (6)$$

where x (mm) is a diameter of said arc electrode.

11. A vacuum bulb comprising:

a fixed electrode and a movable electrode provided in a vacuum vessel, each of said fixed electrode and said movable electrode comprising:

an arc electrode formed of a composite member containing particles of a refractory metal material and a highly conductive metal material; and an electrode supporting portion, made from said highly conductive metal material, for supporting said arc electrode;

wherein said arc electrode and said electrode supporting portion are formed integrally with each other by means of said highly conductive metal material;

said insulating vessel is formed into a cylindrical shape; and a value (y), which is a rating voltage (kV) multiplied by a cutoff current effective value (kA), is in a range not more than a value obtained by an equation (1) and not less than a value obtained by an equation (2):

$$y=11.25x-525 \quad (1)$$

$$y=5.35x-242 \quad (2)$$

where x (mm) is an outside diameter of said insulating vessel.

12. A vacuum bulb comprising:

a fixed electrode and a movable electrode provided in a vacuum vessel, wherein each of said fixed electrode and said movable electrode comprises:

an arc electrode formed of a composite member containing particles of a refractory metal material, and a highly conductive metal material; and an electrode supporting portion, made from said highly conductive metal material, for supporting said arc electrode;

wherein said arc electrode and said electrode supporting portion are formed integrally with each other by means of said highly conductive metal; and a diameter y (mm) of said arc electrode is in a range not more than a value obtained by an equation (3) and not less than a value obtained by an equation (4):

$$y=0.15x+22 \quad (3)$$

$$y=0.077x+18 \quad (4)$$

where x ($kVA\times10^3$) is a rating voltage (kV) multiplied by a cutoff current effective value (kA).

13. A vacuum circuit breaker comprising:

a vacuum bulb as claimed in claim 11;

terminals for connecting external conductors to said fixed electrode and said movable electrode; and an opening/closing means for driving said movable electrode.

14. A vacuum circuit breaker comprising:

a vacuum bulb as claimed in claim 12;

terminals for connecting external conductors to said fixed electrode and said movable electrode.

* * * * *